US008378950B2

(12) United States Patent
Endo et al.

(10) Patent No.: US 8,378,950 B2
(45) Date of Patent: Feb. 19, 2013

(54) DISPLAY DEVICE

(75) Inventors: Kenta Endo, Mobara (JP); Yoshihiro Imajo, Mobara (JP); Yoshihisa Ooishi, Yokohama (JP); Ikuko Mori, Chiba (JP); Shisei Katou, Mobara (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1105 days.

(21) Appl. No.: 12/331,502

(22) Filed: Dec. 10, 2008

(65) Prior Publication Data

US 2009/0091558 A1 Apr. 9, 2009

Related U.S. Application Data

(62) Division of application No. 11/190,888, filed on Jul. 28, 2005.

(30) Foreign Application Priority Data

Jul. 30, 2004 (JP) ..... 2004-223121

(51) Int. Cl.
*G09G 3/36* (2006.01)

(52) U.S. Cl. ..... 345/98; 345/99; 345/100; 345/55

(58) Field of Classification Search ..... 345/98, 345/99–100, 55
See application file for complete search history.

(56) References Cited

U.S. PATENT DOCUMENTS 6,693,618 B2 * 2/2004 Son et al. ..... 345/99
7,006,069 B2 * 2/2006 Tanaka et al. ..... 345/98

FOREIGN PATENT DOCUMENTS

JP 2004-29506 1/2004
JP 2004-212747 7/2004

* cited by examiner

*Primary Examiner* — William Boddie
*Assistant Examiner* — Leonid Shapiro
(74) *Attorney, Agent, or Firm* — Antonelli, Terry, Stout & Kraus, LLP.

(57) ABSTRACT

The present invention provides a display device which displays a black image by periodically inserting the black image, wherein after the display of the black image, a first period in which a video signal different from a video signal for the black image is outputted to video signal lines is made different from a succeeding period in length.

6 Claims, 20 Drawing Sheets

DISPLAY DEVICE

CROSS REFERENCE TO RELATED APPLICATION

This application is a divisional application of U.S. application Ser. No. 11/190,888, filed Jul. 28, 2005, the contents of which are incorporated herein by reference.

BACKGROUND OF THE INVENTION

The present invention relates to a display device.

With respect to a display method for producing images on a display device, to consider each pixel region, the display method can be classified into an impulse-type display method which repeats a display time and a non-display time, as represented by a CRT (cathode ray tube), and a hold-type display method which produces a display continuously, as represented by a liquid crystal display device or an organic EL display device. In consideration of these two display methods, in the hold-type display method, the response speed as viewed with the naked eye is also influenced by the time during which the image is held, and, hence, there is a drawback in that the response speed of the hold-type display device appears to be slower than the response speed of the impulse-type display device.

On the other hand, Japanese Patent Laid-open 2004-212747 describes a technique in which the typical display image is displayed for n lines, and, thereafter, a black image corresponding to m lines (n=m=4 as an example) is collectively displayed, thus realizing a pseudo impulse-type display which can enhance the response speed as viewed with the naked eye.

SUMMARY OF THE INVENTION

However, the inventors of the present invention have found that, along with the growing size of display devices, or when the operational frequency is enhanced (for example, 80 Hz or more) to further improve the response speed as viewed with the naked eye by increasing the interval that black appears, or along with an increase of the pixel capacitance, there exists a possibility that the application of the technique disclosed in Japanese Patent Laid-open 2004-212747 gives rise to various peculiar display irregularities. In view of the above, the inventors have also found that, to overcome such a drawback, it is desirable to apply a further image quality enhancement technique.

Since the peculiar display irregularities exist in various forms, the details of the peculiar display irregularities will be explained with reference to various embodiments of the present invention.

Typical ways to overcome the above-mentioned peculiar display irregularities are as follows, for example.

(1) A display device according to the present invention, for example, displays a black image by periodically inserting the black image, wherein after the display of the black image, a first period in which a video signal different from a video signal for the black image is outputted to video signal lines is made different from a succeeding period in length.

(2) The display device according to the present invention, for example, on the premise of the constitution (1), is characterized in that the display device is driven in the first period in a state such that the polarity of the video signal differs between the first period and the succeeding period and the first period is set shorter than the succeeding period.

(3) The display device according to the present invention, for example, on the premise of the constitution (1), is characterized in that the display device is driven in the first period in a state such that the polarity of the video signal is equal between the first period and the succeeding period and the first period is set so that it is longer than the succeeding period.

(4) The display device according to the present invention, for example, on the premise of the constitution (2), is characterized in that the display device is driven in the first period in a state such that the polarity of the video signal differs between the first period and the succeeding period and the first period is set so that it is shorter than other periods.

(5) The display device according to the present invention, for example, on the premise of the constitution (3), is characterized in that the display device is driven in the first period in a state such that the polarity of the video signal is equal between the first period and the succeeding period and the first period is set so that it is longer than other periods.

(6) The display device according to the present invention, for example, on the premise of the constitution (1), is characterized in that the display device is driven in a state such that the polarity of the video signal differs between the first period and the succeeding period, and an ON period of a gate signal in the first period is shorter than the ON period of the gate signal in the succeeding period.

(7) The display device according to the present invention, for example, on the premise of the constitution (1), is characterized in that the display device is driven in a state such that the polarity of the video signal is equal between the first period and the succeeding period, and an ON period of a gate signal in the first period is longer than the ON period of the gate signal in the succeeding period.

(8) A display device according to the present invention, for example, displays a black image by periodically inserting the black image, wherein an ON voltage of gate signal lines which are turned on firstly after displaying the black image is set to a value different from an ON voltage of the gate signal lines which are turned on subsequently.

(9) The display device according to the present invention, for example, on the premise of the constitution (8), is characterized in that the ON voltage of gate signal lines which are turned on firstly after displaying the black image is driven in a state such that a first video signal, after displaying the black image, and a succeeding video signal differ in polarity, and is set lower than an ON voltage of the gate signal lines which are turned on secondly after displaying the black image.

(10) The display device according to the present invention, for example, on the premise of the constitution (8), is characterized in that the ON voltage of gate signal lines which are turned on firstly after displaying the black image is driven in a state such that a first video signal, after displaying the black image, and a succeeding video signal are equal in polarity and is set higher than an ON voltage of the gate signal lines which are turned on secondly after displaying the black image.

(11) A display device according to the present invention, for example, displays a black image by periodically inserting the black image, wherein, when a signal which allows the display device to display a display image having uniform luminance is inputted from the outside, a voltage of a first video signal and a voltage of a third video signal, after displaying the black image, take values different from each other.

(12) The display device according to the present invention, for example, on the premise of the constitution (11), is characterized in that, in driving the display device in a state such that the first video signal and the second video signal, after displaying the black image, are different from each other in polarity, the voltage of the first video signal is lower than the voltage of the third video signal.

(13) The display device according to the present invention, for example, on the premise of the constitution (11), is characterized in that, in driving the display device in a state such that the first video signal and the second video signal after displaying the black image, are equal in polarity, the voltage of the first video signal is higher than the voltage of the second video signal.

(14) A display device according to the present invention, for example, displays a black image by periodically inserting the black image, wherein the timing at which gate signal lines are turned on in response to the black image displayed by insertion is delayed relative to the timing at which the gate signal lines are turned on in response to images other than the black image displayed by insertion.

(15) A display device according to the present invention, for example, displays a black image by periodically inserting the black image, wherein a period during which gate signal lines are turned on in response to the black image displayed by insertion is shorter than a period during which the gate signal lines are turned on in response to images other than the black image displayed by insertion.

(16) A display device according to the present invention, for example, displays a black image by periodically inserting the black image, wherein the voltage of the video signal lines which correspond to a black image displayed by insertion is set to a value different from the voltage of the video signal lines at the time of performing a black image display as an image.

(17) The display device according to the present invention, for example, on the premise of the constitution (16), is characterized in that the different value is set lower than the voltage of the video signal lines at the time of displaying the black image which constitutes an image when the polarity of a video signal immediately before the black image displayed by insertion is positive and it is set higher than the voltage of the video signal lines at the time of displaying the black image which constitutes an image when the polarity of a video signal immediately before the black image displayed by insertion is negative.

(18) A display device according to the present invention, for example, displays a black image by periodically inserting the black image, wherein an ON voltage of gates which correspond to the black image displayed by insertion is set higher than an ON voltage of other gates.

(19) A display device according to the present invention, for example, displays a black image by periodically inserting the black image, wherein the timing at which video signal lines rise with respect to the rising of gate signal lines is set earlier at a side close to a gate signal line drive circuit than at a side remote from the gate signal line drive circuit.

In the display device which enhances the response speed as viewed with naked eye by periodically repeating a usual image display and a black image display, peculiar display irregularities attributed to display methods thereof can be reduced and a rapid and beautiful display can be realized.

DETAILED DESCRIPTION OF THE INVENTION

Hereinafter, various embodiments of a display device according to the present invention will be explained in conjunction with drawings.

<Schematic Overall Constitution>

Figure 1:
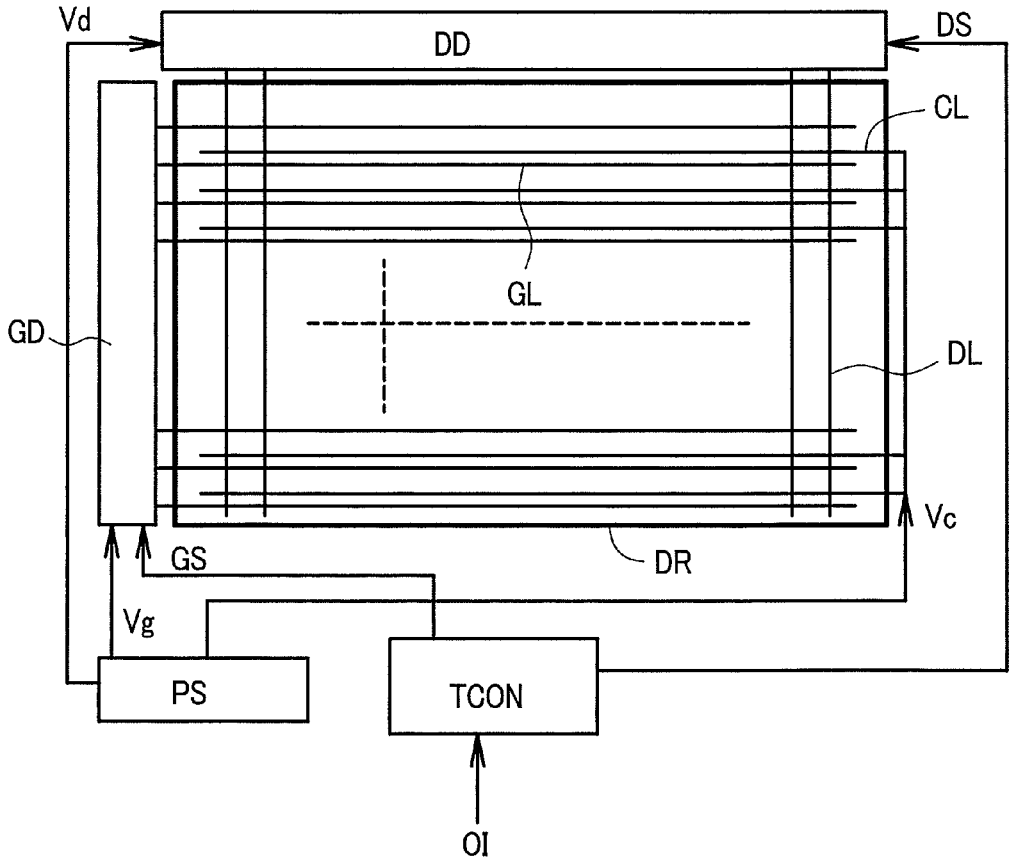
FIG. 1 is a schematic system block diagram showing one example of a system of a display device according to the present invention.

A display device according to the present invention includes a display element as a constitutional element. FIG. 1 is a schematic system block diagram showing a path for generating display signals to the display element in response to a signal from a controller TCON. A signal from the outside of the display device, for example, a TV signal, a PC signal and other various kinds of control signals, are inputted to the controller TCON as external outputs OI. The controller TCON processes the respective signals into signals for performing an image display on the display element. The signals differ depending on the display element. For example, depending on whether the display element is a liquid crystal display device, the display element is an EL display device, the display element is a FED display device and the like, the signals are processed into signals which are necessary in conformity with the respective display devices. To consider the case in which the display device is the liquid crystal display device as an example, a video signal line drive circuit signal DS is supplied to a video signal line drive circuit DD from the controller TCON, and a gate signal line drive circuit signal GS is supplied to a gate signal line drive circuit GD from the controller TCON. Various voltages Vd for the video signal line drive circuit, which contains a drive voltage of the circuit per se and a plurality of gray-scale reference voltages, are supplied to the video signal line drive circuit DD from a power source circuit PS, while a drive voltage of the gate signal line drive circuit per se and various voltages Vg for the gate signal line drive circuit, which become the reference of the gate voltage, are supplied to the gate signal line drive circuit GD from the power source circuit PS. Further, as a common potential of the display element, a common signal line voltage Vc is supplied. A video signal is supplied to video signal lines DL from the video signal line drive circuit DD, gate signals are supplied to gate signal lines GL from the gate signal line drive circuit GD, and the potential of the video signal lines DL is supplied to pixel electrodes PX (described later) in response to a control signal of the gate signal lines GL from the gate signal line drive circuit GD through switching elements TFT formed on respective pixels. By driving liquid crystal molecules in accordance with electric fields or voltage differences between the pixel electrodes PX and a common signal line voltage Vc, the state of the liquid crystal layer is changed so as to realize an image display. A plurality of video signal lines DL and a plurality of gate signal lines GL are arranged in a matrix array, thus constituting a display region DR. In the display region, as regions which are surrounded by the neighboring video signal lines DL and the neighboring gate signal lines GL, a large number of pixel regions are formed.

<Explanation of an Example of Display Concept of Black Image>

Figure 2:
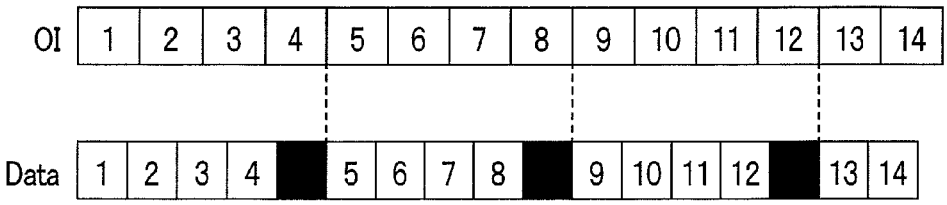
FIG. 2 is a conceptual diagram illustrating the insertion of a black image.

FIG. 2 is a diagram showing a concept for displaying the black image on the display device. From the external input OI, information to be sequentially displayed on respective pixels, which are connected to the video signal lines DL, are inputted in the order of 1, 2, 3, 4, 5. Since information on how the black data is periodically displayed is not present in the information given from the outside, the information is modified to information which contains the black information using the controller TCON. The display data after modification is expressed as Data. The black data is provided after 1, 2, 3, 4, and, thereafter, the black data is provided after 5, 6, 7, 8. In this manner, as an example, the data set which displays one black data for four display data is prepared. Here, to completely display the information inputted from the outside on the display device, the display period for each display data inputted in the order of 1, 2, 3, 4 is set shorter than a corresponding display period produced in a method which does not perform the black display.

Figure 3:
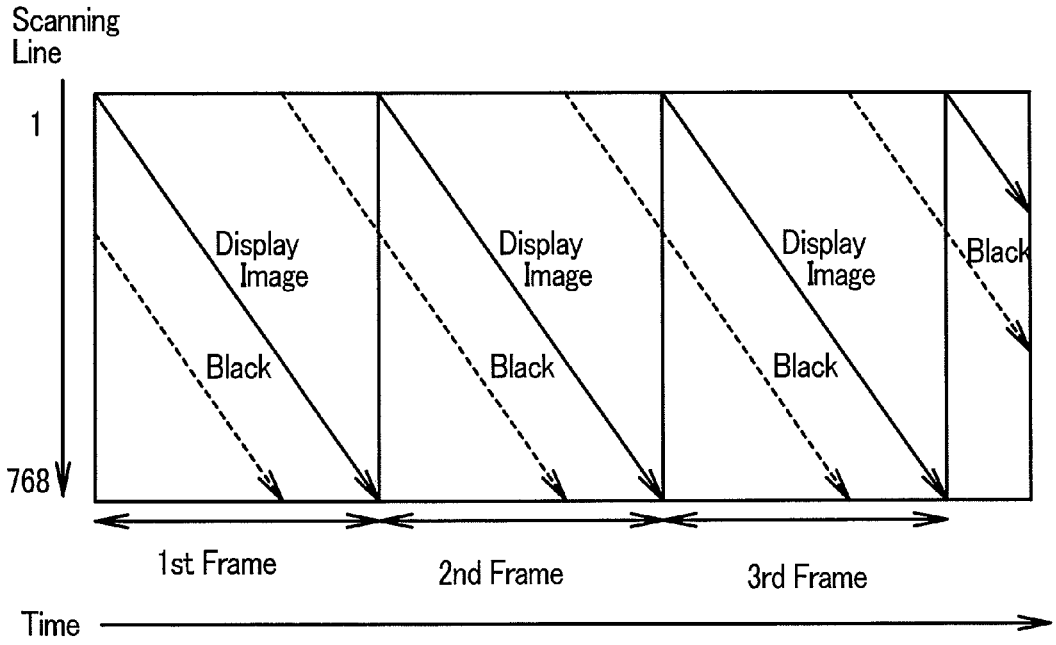
FIG. 3 is a diagram showing an example of display timing of display data and a black image.

FIG. 3 is an explanatory view to show how Data generated in FIG. 2 is displayed. An axis of abscissas corresponds to a time axis and an axis of ordinates corresponds to a position of the scanning line (gate signal line GL). A rectangular region corresponds to a frame. There are display devices of various resolutions, but, for example, XGA has at least 768 scanning lines.

First of all, as indicated by an oblique solid line, in the first frame, the display image is sequentially written in the pixels from an initial scanning line (the first scanning line) to a last display line (the 768th line). In the usual display device, this writing is repeated in the second frame and the third frame. On the other hand, in the method which displays a black image, black writing, which is indicated by a broken line, is added. The image indicated by the solid line and the black displayed by the broken line are arranged in parallel to each other. This implies that, by writing the black when a fixed time lapses after the writing of the video signal, each pixel performs the usual image display and the black display repeatedly, and, hence, a visual response speed can be enhanced.

Figure 4:
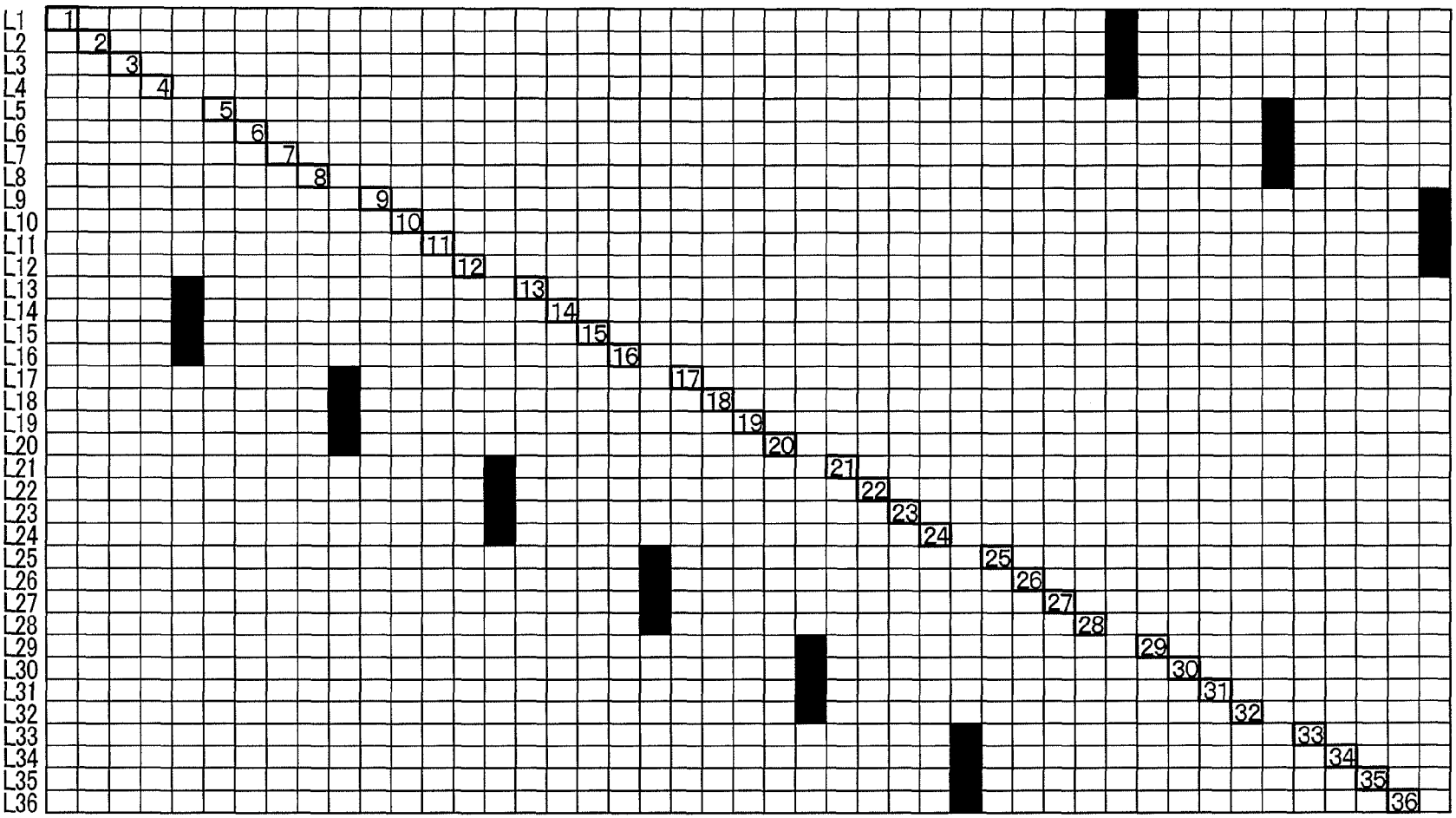
FIG. 4 is a diagram showing an example of display timing of display data and a black image.

The manner of writing timing of the display data and the black data as shown in FIG. 3 will be explained further in detail in conjunction with FIG. 4. In FIG. 4, for facilitating the explanation, the explanation is given with respect to a case in which 36 scanning lines L1 to L36 are used. Although the concept is the same even when the number of scanning lines is increased, the number of scanning lines is reduced in the drawing because all of the scanning lines cannot be illustrated on the drawing. An axis of abscissas is a time axis as in the case of FIG. 3.

Signals which are applied to the video signal lines DL will be sequentially explained in conjunction with FIG. 4. First of all, the display images 1, 2, 3, 4 are sequentially written in the pixels corresponding to the scanning lines L1 to L4 in synchronism with the turning ON of the gate signal lines GL. Next, the black data is applied to the video signal lines. Here, when the gate signal line GL corresponding to the slightly spaced-apart four lines L13 to L16 is turned ON, black data is simultaneously written in the pixels corresponding to the four lines L13 to L16. Next, the images 5, 6, 7, 8 are sequentially written in the pixels corresponding to the scanning lines L5 to L8 in synchronism with the turning ON of the gate signal lines GL. Next, black data is applied to the video signal lines. Here, when the gate signal line GL corresponding to the four lines L17 to L20, which follow the four lines L13 to L16 in which the black was previously written, is turned ON, black data is simultaneously written in the pixels corresponding to the four lines L17 to L20. Thereafter, the writing of the images and black data is continued, as shown in FIG. 4.

After the images 21, 22, 23, 24 are written in the scanning lines L21 to L24, the black image is written in the scanning lines L33 to L36. Thus, the black image is written until the lowermost stage of the display region. Accordingly, the writing of the black data thereafter returns to the head of the scanning lines. That is, the image data 25, 26, 27, 28 are written in the scanning lines L25 to L28, and, subsequently, black data is inputted to the video signal line DL. Here, when the gate signal lines GL corresponding to the scanning lines L1 to L4 are turned ON black data is simultaneously written in four lines L1 to L4. Thereafter, the black display is, as shown in FIG. 2, subsequently repeated to the lower lines. By writing the images 33 to 36 in the scanning lines L33 to L36, the display of the images is completed on all lines L1 to L36. Following the images 33 to 36, black is displayed on the scanning lines L9 to L12, and, hence, the display of black on all lines is also completed.

In this manner, the display of both information consisting of the images and black on all lines can be realized.

Figure 5:
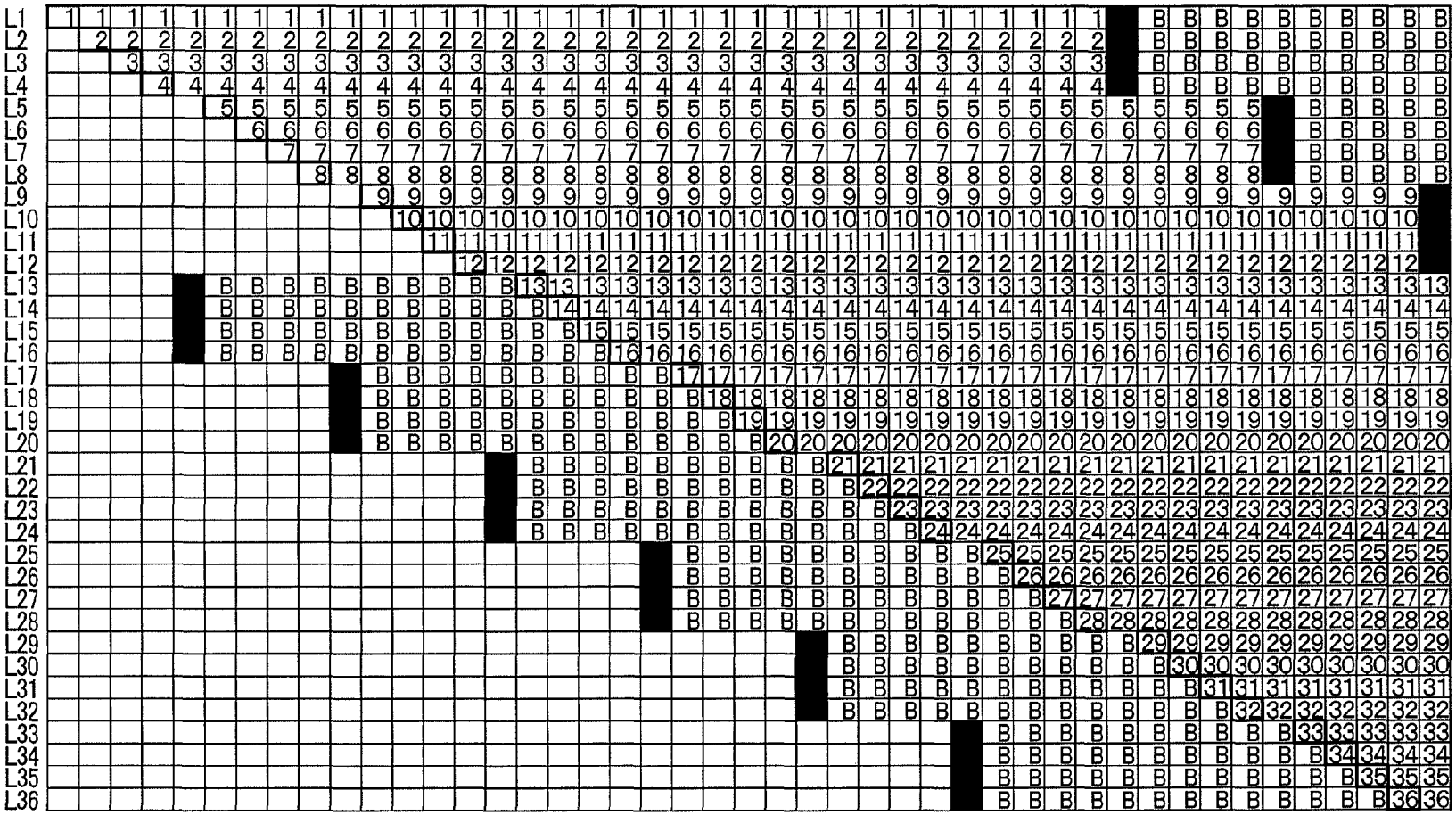
FIG. 5 is a diagram showing an example of display timing of display data and a black image.

FIG. 5 is an explanatory view corresponding to FIG. 4 and that shows the video signals and the black signals which are written for every line in a more easily understandable manner.

Numerals 1 to 36, which are surrounded by bold black frame lines, indicate the information that is written in the pixels at such timings. Besides the above, the numerals also indicate that the images of the numerals are held by the switching elements TFT and the display thereof is continued. Black matted portions indicate that the black is written in the pixels at such timings. B indicates that the black display is continued.

Figure 6:
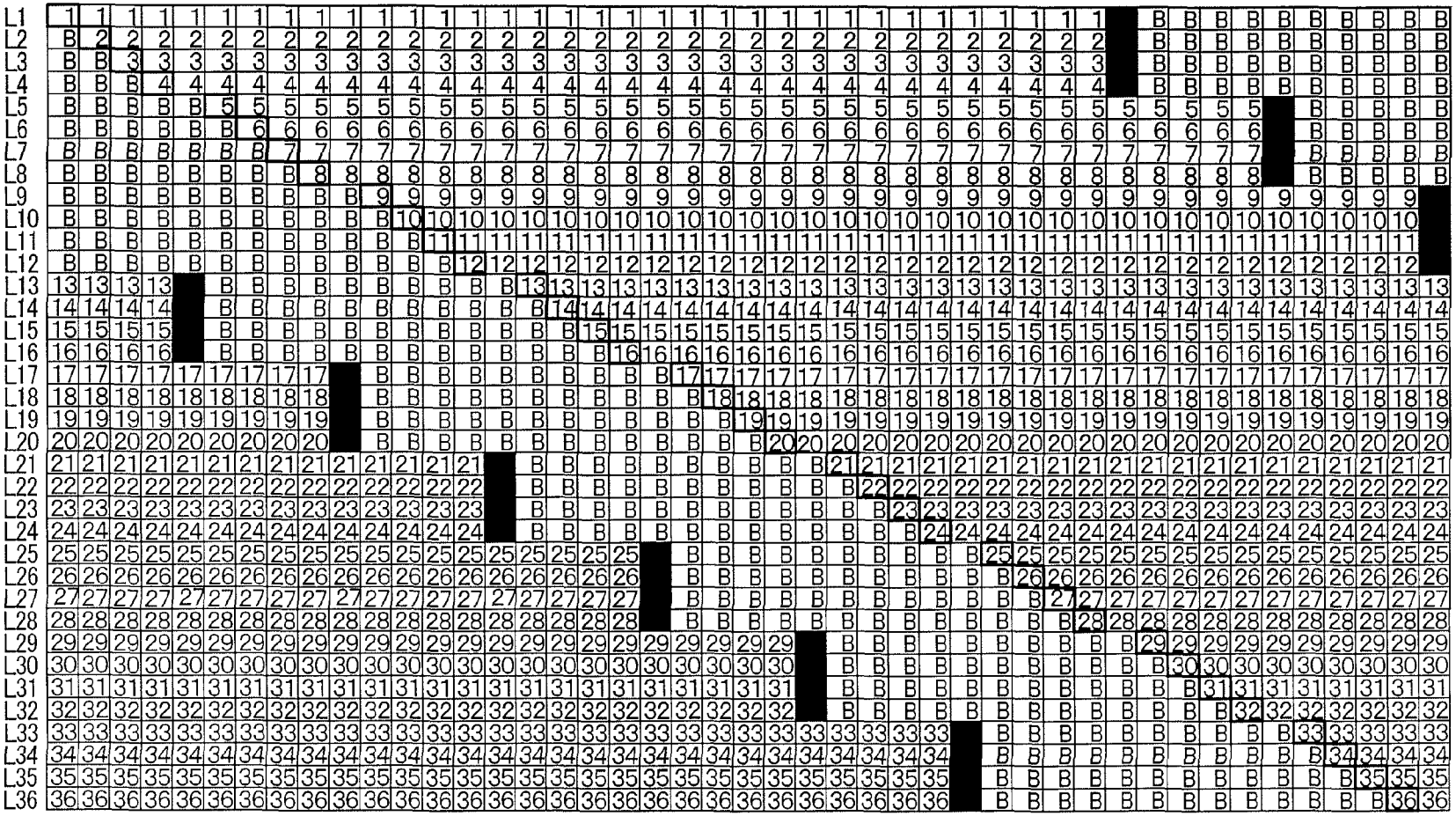
FIG. 6 is a diagram showing an example of display timing of display data and a black image.

After the image "1" is written in the scanning line L1, the image "1" is continuously displayed. Thereafter, the black data is written and the black image "B" is continuously displayed. The same display operation is performed in the same manner up to the scanning line L12. In the scanning lines L13 to L36, the black image "B" is firstly written, and, thereafter, the image is written. Although the timing at which black is written differs in this manner in the first 1 frame, this operation takes place within a moment of less than 0.1 second after the start of the display device, and, thereafter, the display pattern shown in FIG. 6 is repeated. Accordingly, the ratio between a image display period and a black display period becomes substantially equal on each line.

Here, the reason why the ratio between the image display period and the black display period is referred to as being substantially equal lies in the fact that since, black is written in four lines, for example, simultaneously, a time lag of several 10 μs is generated in the ratio between the image display period and the black display period with respect to the neighboring four lines. However, the time lag of this level of the display time is too trivial to be noticeable as viewed with naked eye. Particularly, the higher the resolution, the more the difference is decreased, and the difference is at a practically allowable level in a device of high resolution, such as XGA or more, for example. From this point of view, the wording "substantially equal" is used.

<Manner to Cope with First Phenomenon>

Figure 7:
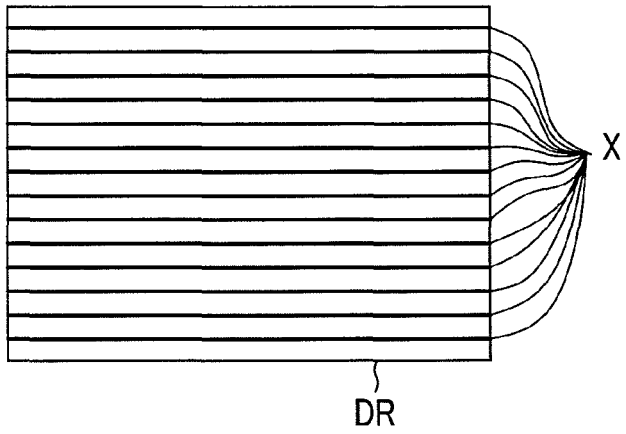
FIG. 7 is a diagram of a stripe-like defective display.

FIG. 7 shows one example of a phenomenon with which the present invention copes. Inventors of the present invention have found a phenomenon in that, when a uniform intermediate gray scale is displayed in a display region DR, a plurality of lines which differ in luminance are viewed in a stripe shape, as indicated by X. As a result of an investigation, it is found that this phenomenon is generated due to the fact that an effective voltage written in the pixels differs between the first line after the black image is written and succeeding lines.

This phenomenon will be explained in conjunction with FIGS. 8A and 8B and FIGS. 9A and 9B. In these drawings, L4 to L8 and B indicate the writing of data, as explained in conjunction with FIG. 4 to FIG. 6.

Figure 8A:
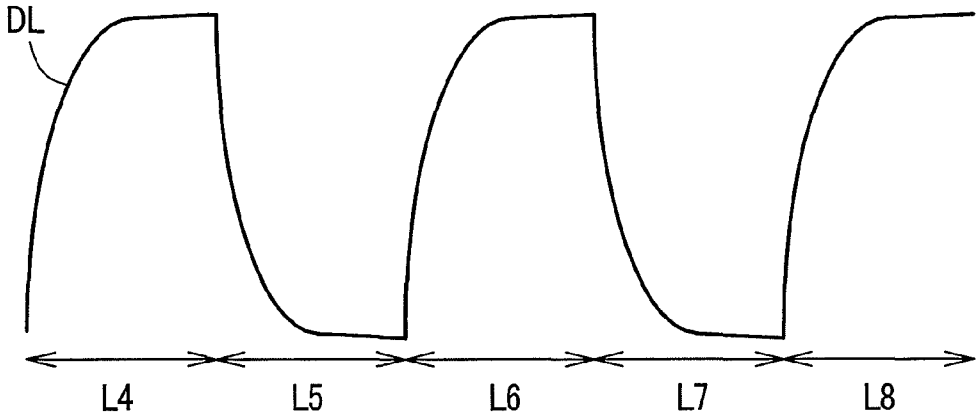
FIGS. 8A and 8B are waveform diagrams in which waveforms are compared between a case in which the black writing is not performed and a case in which the black writing is performed, respectively.
Figure 8B:
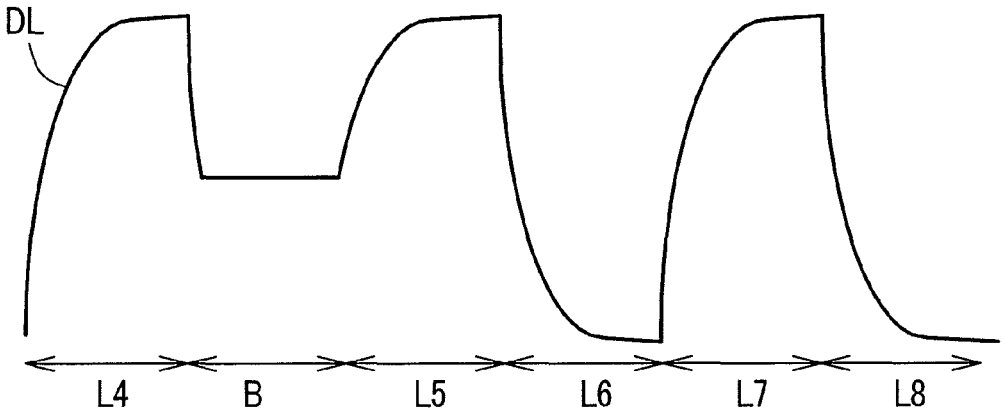

FIG. 8A is the view which shows a signal which is applied to the video signal lines DL in a usual case in which the black writing is not performed. When a uniform image is displayed, in conjunction with dot inversion driving or driving that is substantially equal to the dot inversion driving, signals of the same gray scale which differ in then polarities are sequentially applied to the video signal lines DL. FIG. 8B shows the case in which black writing is performed. As an example, corresponding to the explanation made in conjunction with FIG. 4 to FIG. 6, a signal is shown which is applied to the video signal lines DL when black is written in the scanning lines L13 to L16 between L4 and L5. FIG. 8B shows that, during a period B, for the purpose of writing black data, the black voltage, which completely differs from the voltages in L4 or L5 to L8, is applied to the video signal lines DL.

Figure 9A:
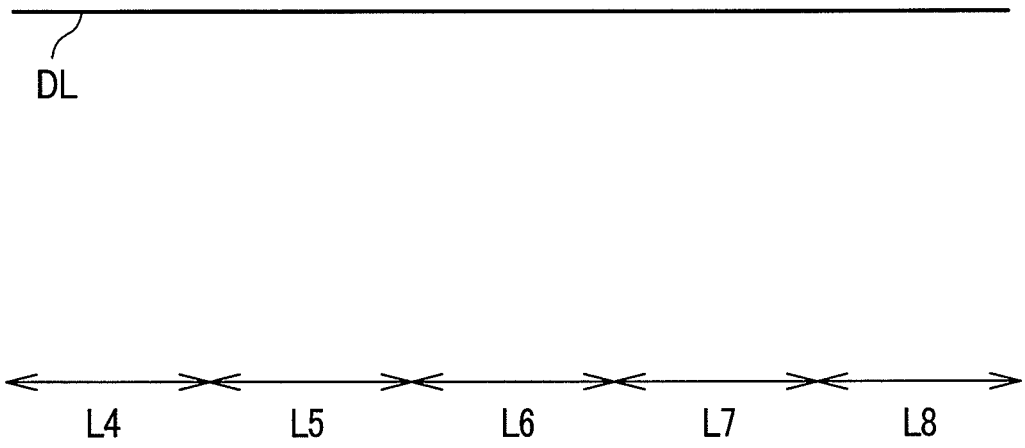
FIGS. 9A and 9B are waveform diagram in which waveforms are compared between a case in which the black writing is not performed and a case in which the black writing is performed, respectively.
Figure 9B:
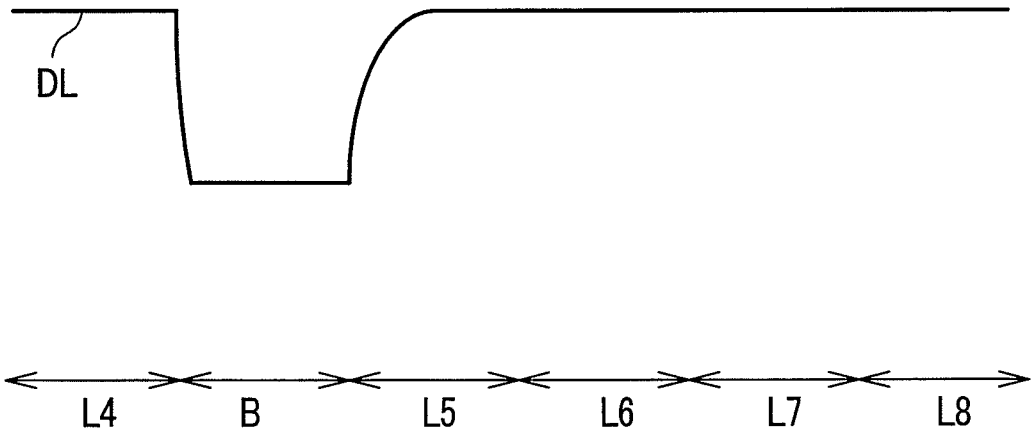

FIG. 9A and FIG. 9B respectively correspond to FIG. 8A and FIG. 8B, and they show signals in the frame inversion compared to the example of the dot inversion shown in FIG. 8A and FIG. 8B. It is understood that the frame inversion shown in FIG. 9A and FIG. 9B and the dot inversion shown in FIG. 8A and FIG. 8B are common with respect to the point that a completely different voltage is applied in writing black data.

As can be appreciated from FIG. 8B, the change quantity of the voltage from B to L5 is approximately one half compared to the change quantity of the voltage from L5 to L6, from L6 to L7 and from L7 to L8. Accordingly, the voltage can be easily written in the pixels in L5 compared to L6 to L8, and, hence, the luminance in L5 differs from the luminance in L6 to L8. It is understood that, in the case shown in FIG. 9B, on the contrary, the change quantity of voltage from B to L5 is large compared to the change quantity from L5 to L6, from L6 to L7 and from L7 to L8. Accordingly, it is difficult to write the voltage in the pixels in L5 compared to L6 to L8, and, hence, there arises a possibility that the luminance of L5 will be different from the luminance of L6 to L8. This is a cause to the phenomenon X in FIG. 7. Since the phenomenon is generated corresponding to the writing of black data, when black is written in a four line unit, black appears in every four lines.

Figure 10A:
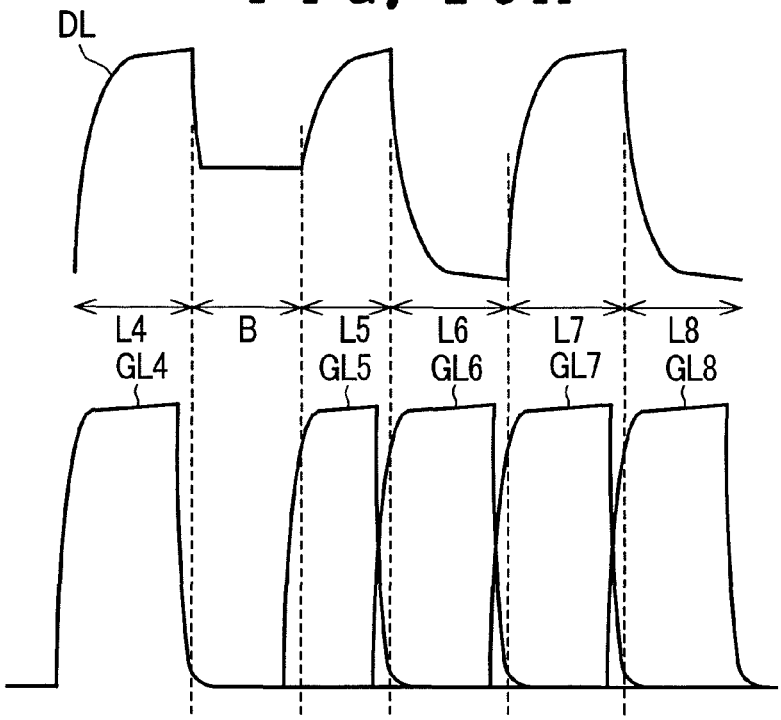
FIGS. 10A and 10B are diagrams showing one example of driving according to the present invention.

FIG. 10A shows the driving which is employed for eliminating the stripe-like luminance fluctuation at the time of performing the dot inversion shown in FIG. 8B. The upper side of FIG. 10A shows a signal of the video signal lines DL which corresponds to FIG. 8B, and the lower side of FIG. 10A shows the respective gate signal lines GL in L4 to L8, and they are indicated as GL4 to GL8, corresponding to L4 to L8. By setting the time of L5 shorter than the times of L6 to L8, the writing time of L5 can be made shorter than the writing times of L6 to L8, thus approximating the voltage written in the pixels in L5 to that in L6 to L8. Accordingly, it is possible to suppress any fluctuation of the luminance.

Figure 10B:
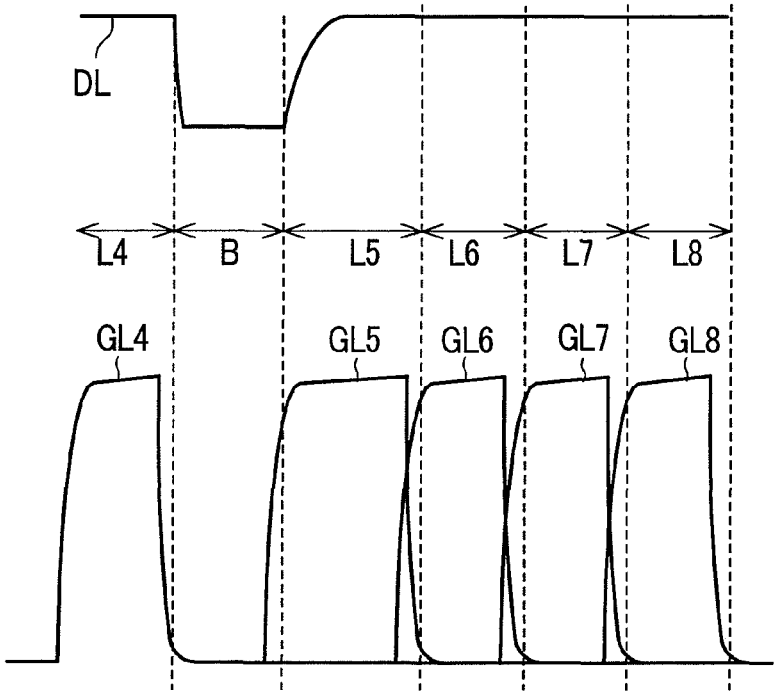

FIG. 10B shows the driving which is employed for eliminating the stripe-like luminance fluctuation at the time of performing the frame inversion shown in FIG. 9B. The upper side of FIG. 10B shows a signal of the video signal lines DL which corresponds to FIG. 9B, and the lower side of FIG. 10B shows the respective gate signal lines GL in L4 to L8, and they are indicated as GL4 to GL8, corresponding to L4 to L8. By setting the time of L5 longer than the times of L6 to L8, the writing time of L5 can be made longer than the writing times of L6 to L8, thus approximating the voltage written in the pixels in L5 to that in L6 to L8. Accordingly, it is possible to suppress any fluctuation of the luminance.

FIG. 10A and FIG. 10B show a concept of the present invention wherein, for example, in a display device which periodically displays a black image by insertion, after performing the display of the black image, a first period, during which the video signal which differs from the black image is outputted to the video signal lines, is set to a length different from the length of the period which succeeds the first period.

Further, FIG. 10A shows a concept of the present invention wherein the display device is driven in the first period in a state such that the polarity of the video signal differs between the first period and the succeeding period, and the first period is set shorter than the succeeding period.

Further, FIG. 10A shows a concept of the present invention wherein the display device is driven in the first period in a state such that the polarity of the video signal differs between the first period and the succeeding period, and the first period is set shorter than other periods.

Still further, FIG. 10A shows a concept of the present invention wherein the display device is driven in the first period in a state such that the polarity of the video signal differs between the first period, and the succeeding period and an ON period of the gate signal is set shorter in the above-mentioned first period than it is in the above-mentioned succeeding period.

On the other hand, FIG. 10B shows a concept of the present invention wherein the display device is driven in the first period in a state such that the polarity of the video signal is equal between the first period, and the succeeding period and the first period is set longer than the succeeding period.

Further, FIG. 10B shows a concept of the present invention wherein the display device is driven in the first period in a state such that the polarity of the video signal is equal between the first period, and the succeeding period and the first period is set longer than other periods.

Still further, FIG. 10B shows a concept of the present invention wherein the display device is driven in a state such that the polarity of the video signal differs between the first period and the succeeding period, and an ON period of the gate signal is set longer in the above-mentioned first period than it is in the above-mentioned succeeding period.

Figure 11A:
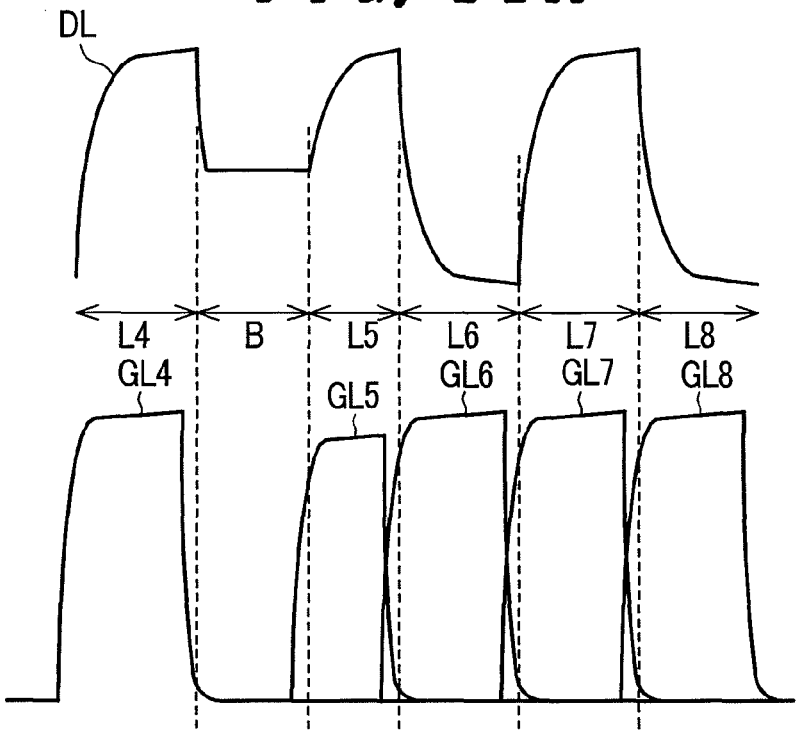
FIGS. 11A and 11B are diagrams showing one example of driving according to the present invention.

FIG. 11A shows another driving technique that is used for eliminating the stripe-like luminance fluctuation at the time of performing the dot inversion shown in FIG. 8B, and it corresponds to FIG. 10A. By setting the gate voltage G5 smaller than the other gate voltages GL6 to GL8, the writing characteristics of the switching elements TFT are made different between L5 and L6 to L8, thus approximating the voltage written in the pixels in L5 to the voltages in L6 to L8. Due to such an operation, it is possible to suppress any fluctuation of the luminance.

Here, although the operation shown in FIG. 11A aims at further enhancement of the advantage by shortening the time of L5 relative to the times of L6 to L8, it is evident that the advantage can be also expected by merely lowering the voltage of GL5 relative to the voltages of GL to GL8, while setting the times of L5 to L8 equal.

Figure 11B:
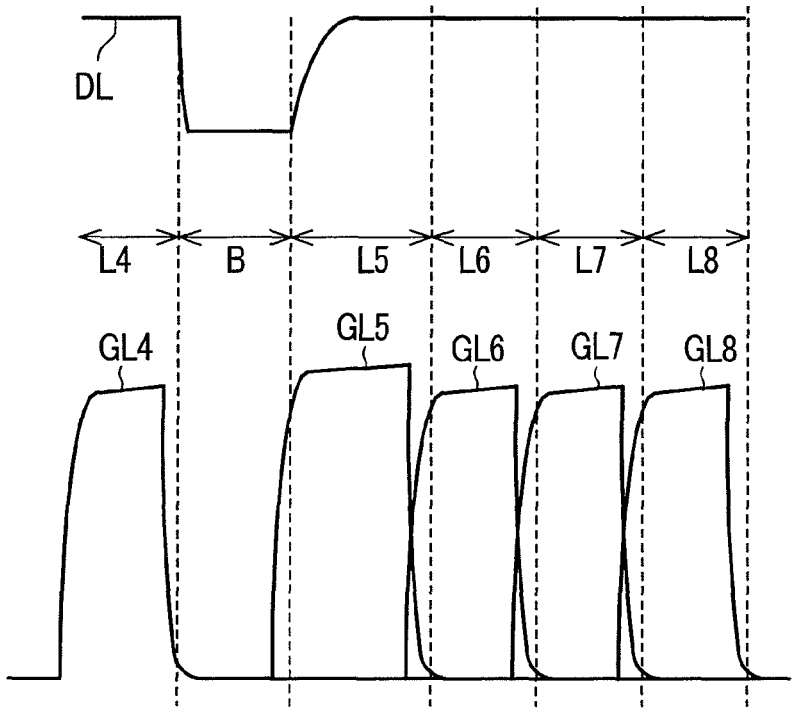

FIG. 11B shows another driving technique which is used for eliminating the stripe-like luminance fluctuation at the time of performing the frame inversion shown in FIG. 9B, and it corresponds to FIG. 10B. By setting the gate voltage G5 larger than the other gate voltages GL6 to GL8, the writing characteristics of the switching elements TFT are made different between L5 and L6 to L8, thus approximating the voltage written in the pixels in L5 to the voltages in L6 to L8. Due to such an operation, it is possible to suppress any fluctuation of the luminance.

Here, although the operation shown in FIG. 11A aims at further enhancement of the advantage by prolonging the time of L5 relative to the times of L6 to L8, it is evident that the advantage can be also expected by merely elevating the voltage of GL5 relative to the voltages of GL to GL8, while setting the times of L5 to L8 equal.

FIG. 11A and FIG. 11B show a concept of the present invention wherein, in a display device which periodically displays a black image by insertion, an ON voltage of the gate signal lines GL, which are turned on firstly after displaying the black image, is set to a value different from the ON voltage of the gate signal lines GL which are turned on subsequently.

Further, FIG. 11A shows a concept of the present invention wherein the ON voltage of the gate signal lines GL, which are turned on firstly after displaying the black image, is driven in a state such that a first video signal after displaying the black image and a succeeding video signal differ in polarity, and it is set lower than an ON voltage of the gate signal lines GL which are turned on secondly after displaying the black image.

Still further, FIG. 11B shows a concept of the present invention wherein the ON voltage of gate signal lines GL, which are turned on firstly after displaying the black image, is driven in a state such that a first video signal after displaying the black image and a succeeding video signal are equal in polarity, and it is set higher than an ON voltage of the gate signal lines GL which are turned on secondly after displaying the black image.

Figure 12A:
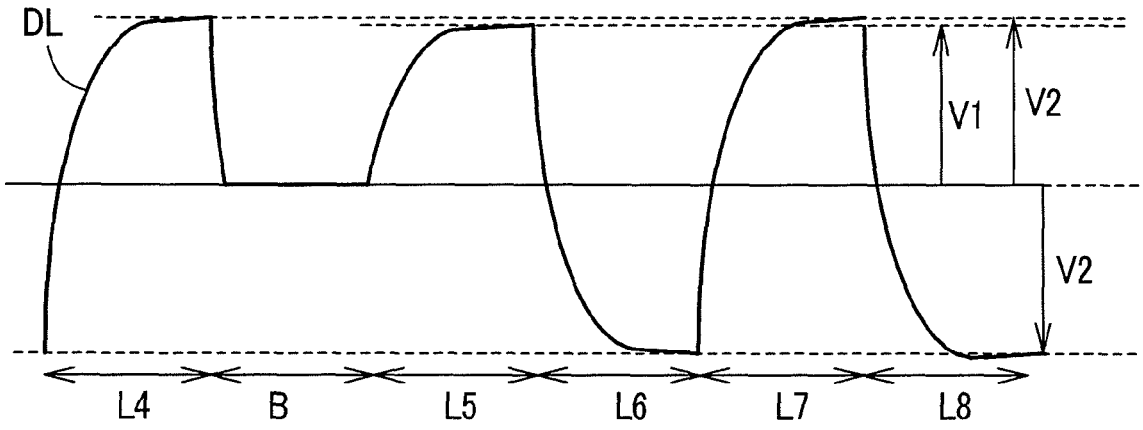
FIGS. 12A and 12B are diagrams showing one example of driving according to the present invention.

FIG. 12A shows another driving technique which is used for eliminating the stripe-like luminance fluctuation at the time of performing the dot inversion shown in FIG. 8B. Assuming that the amplitude of the voltage to be applied to the video signal lines DL originally is V2, by setting the amplitude of the voltage to be applied to the video signal lines DL in a first line after the black writing, that is, in only L5, for example, to V1, which is lower than the original amplitude V2, the voltages which are eventually written in the pixels are made uniform in L5 to L8. This change of voltages can be also achieved by controlling the gray scale values of the data using the controller TCON. For example, when the display device is driven in dot inversion and in a normally black mode, the values of the gray scale data in one line may be replaced with values that are lower than the values of gray scale data in other lines.

Figure 12B:
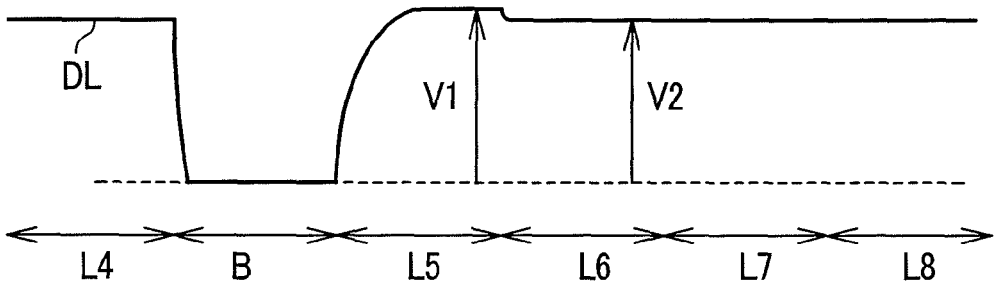

FIG. 12B shows another driving technique which is used for eliminating the stripe-like luminance fluctuation at the time of performing the frame inversion shown in FIG. 9B. Assuming that the amplitude of the voltage to be applied to the video signal lines DL originally is V2, by setting the amplitude of the voltage to be applied to the video signal lines DL in a first line after the black writing, that is, in only L5 to V1, which is higher than the original amplitude V2, the voltages which are eventually written in the pixels are made uniform in L5 to L8. This change of voltages also can be achieved by controlling the gray scale values of the data using the controller TCON. For example, when the display device is driven in frame inversion and in a normally black mode, the values of the gray scale data in one line may be replaced with values that are higher than the values of the gray scale data in the other lines.

FIG. 12A and FIG. 12B show a concept of the present invention wherein, for example, in a display device which periodically displays a black image by insertion, when a signal which allows the display device to display a display image having a uniform luminance is inputted from the outside, the voltage of a first video signal and the voltage of a third video signal after displaying the black image, take values that are different from each other.

Further, FIG. 12A shows a concept of the present invention wherein, in driving the display device in a state such that the first video signal and the second video signal after displaying the black image are different from each other in polarity, the voltage of the first video signal is lower than the voltage of the third video signal.

Still further, FIG. 12B shows a concept of the present invention wherein, in driving the display device in a state such that the first video signal and the second video signal after displaying the black image are equal in polarity, the voltage of the first video signal is higher than the voltage of the second video signal.

<To Cope with Second Phenomenon>

Figure 13A:
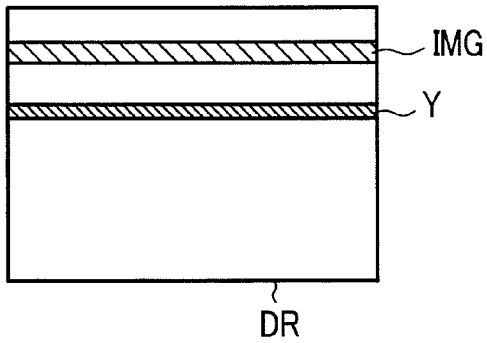
FIGS. 13A and 13B are sectional diagrams which illustrate a ghost phenomenon.
Figure 13B:
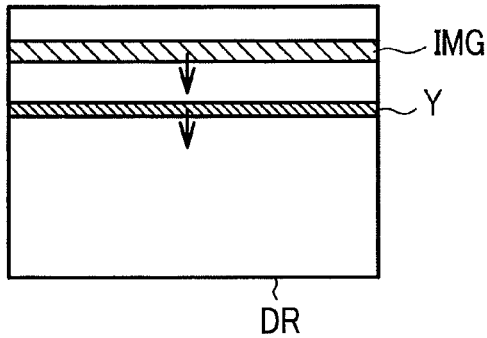

FIGS. 13A to 13D show an example of another phenomenon which the present invention can cope with. As shown in FIG. 13A, when a uniform intermediate gray scale is displayed in the display region DR, and a strip-like image, as indicated by IMG, is displayed in the display region DR, there arises a portion indicated by Y where a strip-like portion which differs in luminance is generated. For facilitating an understanding of this problem, the portion indicated by Y hereinafter will be referred to as a ghost. As shown in FIG. 13B, the ghost is scrolled together with the image IMG when the image IMG is displayed while being scrolled in the direction indicated by the arrows.

Figure 13C:
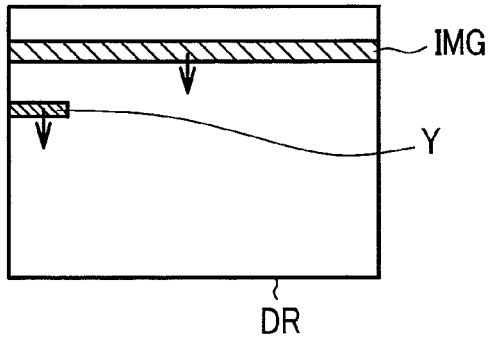
Figure 13D:
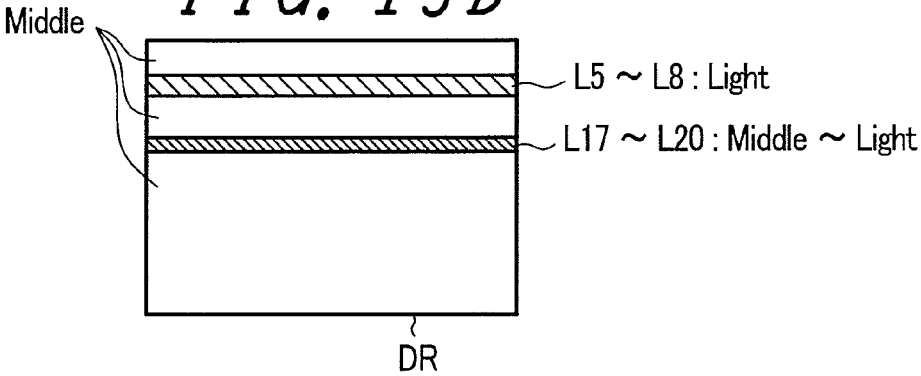

Further, the ghost does not always have a uniform luminance from the right to the left of the screen, and, rather, the inventors of the present invention have found that the luminance is liable to be increased in the vicinity of the gate signal line drive circuit GD, as shown in FIG. 13C. As one example, an explanation will be made with respect to a case in which a black insertion is performed at the timings shown in FIG. 4 to FIG. 6, for example. As shown in FIG. 13D, when a bright display is performed on L5 to L8 and a middle gray scale display is performed on the other lines, the middle-light appears as the ghost at positions corresponding to L17 to L20.

A cause of this phenomenon that the inventors of the present invention have discovered will be explained by taking the case of dot inversion as an example.

Figure 14:
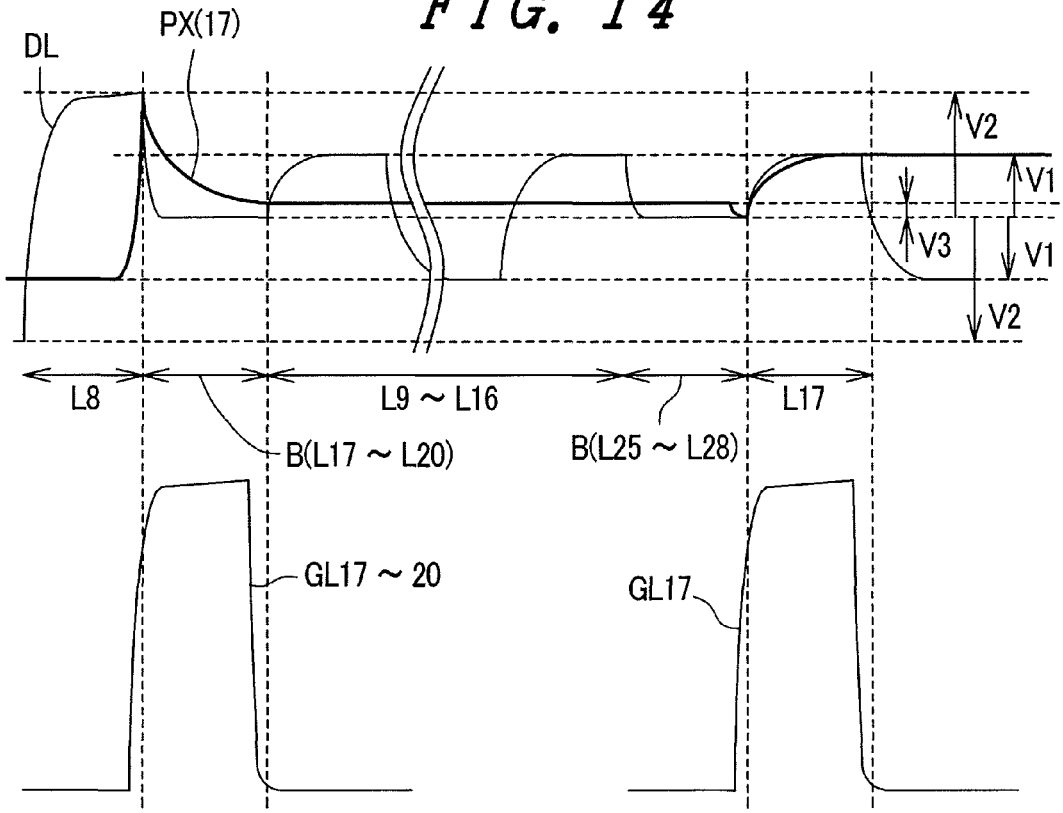
FIG. 14 is a diagram which illustrate the a principle of generation of a ghost phenomenon.

FIG. 14 is a view which shows the relationship between a signal applied to the video signal line DL between L8 to L17 and a voltage PX(17) of the pixel of the line L17. Time is taken on the axis of abscissas. Firstly, a bright image is written in L8, as shown in FIG. 13D, and, hence, the voltage of the video signal line DL assumes a high value. In the example shown in FIG. 4, immediately after writing the image in L8, black is written in L17 to L20. Accordingly, the voltage of the video signal line DL assumes the black voltage B (L17 to L20) for writing black in L17 to L20. Here, as shown in the left lower portion in FIG. 14, an ON voltage is applied to the gate signal lines GL17 to GL20, which correspond to L17 to L20, and the black voltage is written in the pixels corresponding to L17 to L20.

However, since the voltage of L8 assumes a high value at this point of time, it has been found that, when the frequency is high, when the screen size is large or when the pixel capacitance is large, the voltage written in L17 to L20 is shifted from the black voltage. The voltage PX(17), which is written in the pixels corresponding to L17, will be explained.

The voltage of PX(17) holds the display voltage V1 written in the preceding frame in the front half of L8. In the latter half of L8, when GL17 starts to rise, the switching element TFT starts shifting to the ON state, and, hence, a portion of the display voltage V2 of L8 is written in the PX(17). Next, the voltage of the video signal line DL assumes the black level in B (L17 to L20), and GL17 is turned on, and, hence, the voltage of the PX(17) also approaches the black level. However, when the frequency is high, when the screen size is large, or when the pixel capacitance is large, the writing becomes short, and, hence, the GL17 is turned off before the voltage of the PX(17) agrees with the black. As a result, the PX(17) continues to display the voltage which is shifted from the black voltage by V3 during L9 to L16, which is the black display period. Thereafter, the formal middle display voltage V1 is written in the PX(17) in L17, and the display voltage V1 is maintained until the black is written in the next PX(17).

The luminance which a human views with the naked eye is the product which is obtained by integrating the luminance with time. Accordingly, the luminance of the pixel of the PX(17) becomes the combination of the black display period amount of luminance attributed to V3 and the usual display period amount of luminance attributed to V1. Accordingly, the luminance of the PX(17) appears brighter than the luminance which is originally intended due to the presence of V3.

Figure 15:
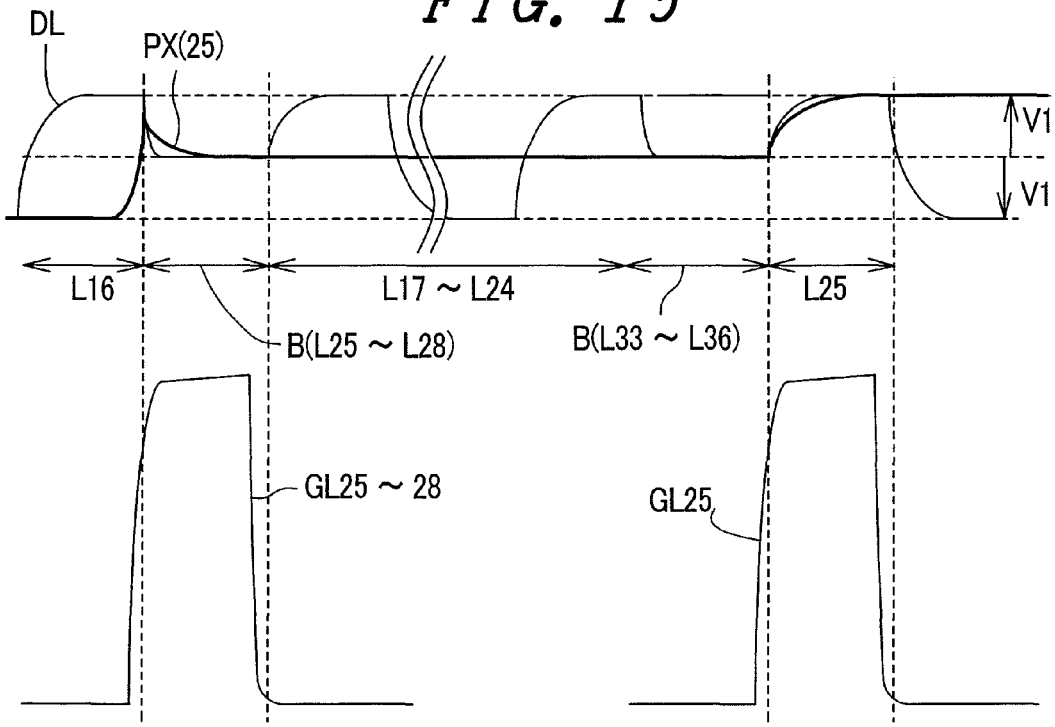
FIG. 15 is a diagram showing one example of driving according to the present invention.

On the other hand, with respect to the lines which are not relevant to L5 to L18, which display the bright image, for example, with respect to L25, such a fluctuation is not generated. This will be explained in more detail in conjunction with FIG. 15, which corresponds to FIG. 14. The middle gray scale is displayed besides L5 to L8. Accordingly, during the period which corresponds to L16 and during the periods which correspond to L17 to L24 and L25, the voltage V1 having the same amplitude is applied. Accordingly, also in the latter half of L16, the voltage elevation of the PX(25) is limited, and, hence, the normal black potential is written due to the writing of black in B (L25 to L28).

Due to the above-mentioned cause, only L17 to L20, which perform the writing of the black immediately after L5 to L8 which display the bright image, appear brighter than the regions which display another middle gray scale by an amount which generates the shifting of V3 with respect to the voltage during the display period of the black.

Figure 16:
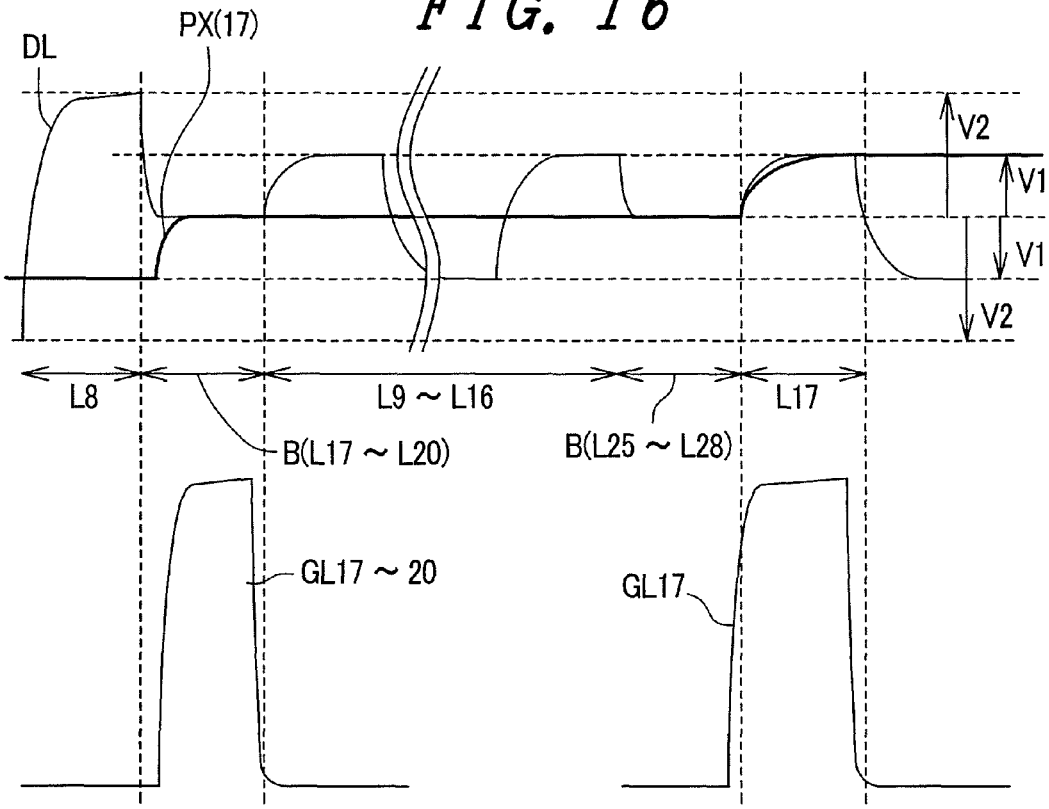
FIG. 16 is a diagram showing one example of driving according to the present invention.

FIG. 16 shows a first technique that may be used to suppress this phenomenon. Since the writing of the display voltage which differs from the black in the latter half of L8 is the cause of the ghost, it is possible to suppress this phenomenon by preventing the voltage of L8 from being written in the PX(17). Accordingly, at the time of producing the black display of GL17 to GL20, that is, at the time of simultaneously turning on the gate signal lines GL on a plurality of lines larger than the lines used at the time of performing the usual display, the timing at which the gate signal lines GL are turned on is delayed relative to the timing (GL17) at which the gate signal lines GL are turned on for the usual image display. While the rise of GL17 to 20, which corresponds to B (L17 to L20) in FIG. 16, is behind a broken line, the rise of GL17 corresponding to L17 is in front of the broken line. By shifting the timing in this manner, it is possible to prevent the voltage of L8 from influencing the voltage at the time of writing black data, and, hence, the ghost can be suppressed.

FIG. 16 shows the concept of the present invention in which, in a display device which displays a black image by periodically inserting a black image, a timing at which gate signal lines GL are turned on in response to the black image displayed by insertion is delayed relative to the timing at which the gate signal lines GL are turned on in response to images other than the black image displayed by insertion.

Further, FIG. 16 shows the concept of the present invention in which, in a display device which displays a black image by periodically inserting a black image, a period during which gate signal lines GL are turned on in response to the black image displayed by insertion is shorter than a period during which the gate signal lines GL are turned on in response to images other than the black image displayed by insertion.

Figure 17:
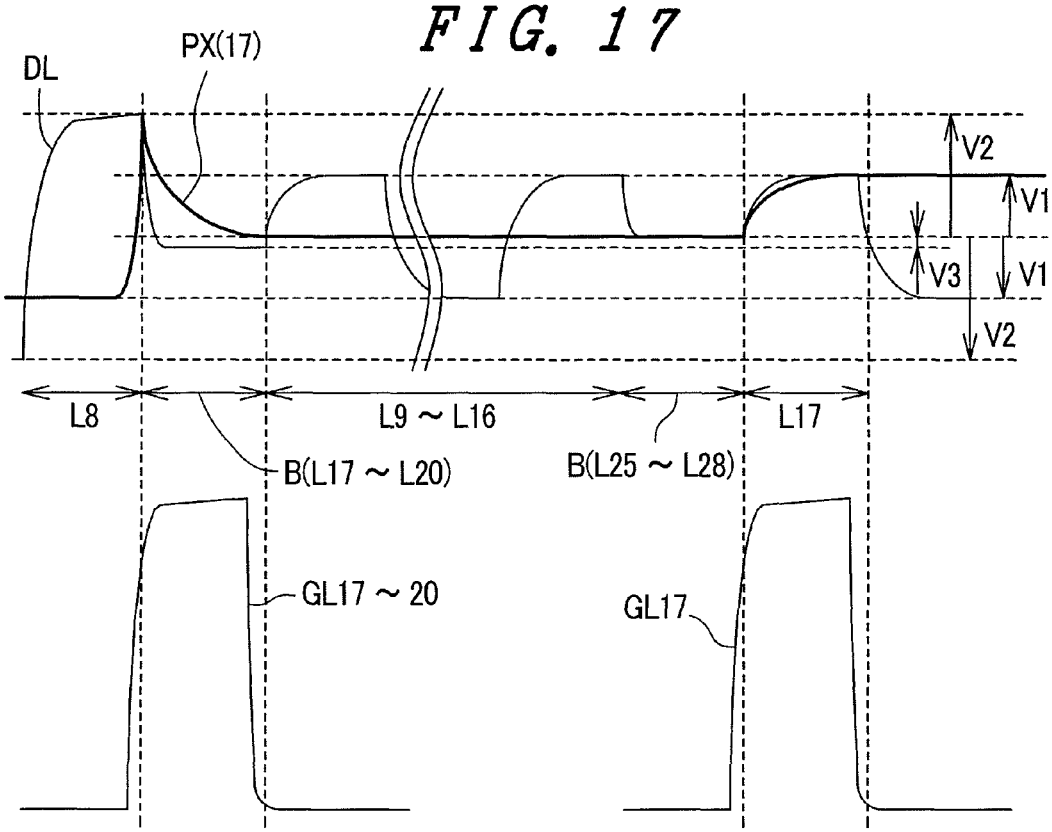
FIG. 17 is a diagram showing one example of driving according to the present invention.

FIG. 17 shows a second concept and corresponds to FIG. 16. In FIG. 17, in place of shifting the timing of the rise of the gate signal lines GL, the voltage or the gray scale of the video signal lines DL is controlled. That is, by reference to a table which predetermines the fluctuation V3, which the voltage V2 of the video signal lines affects in L8, the voltage applied to the video signal lines DL in B (L17 to L20) is shifted by an amount V3. Accordingly, it is possible to approximate the black voltage written in the PX(17) to the black voltage written in other normal lines. In the example shown in FIG. 17, the voltage in B (L17 to L20) is set lower than the voltage at the time of the other black writings.

The ideal voltage which is written in the pixels at the time of black writing is a particular state of being black. Further, it is possible to preliminarily calculate how much the display voltage immediately before the black writing influences the voltage at the time of black writing based on design and simulation. Accordingly, based on the calculated values, the voltage of V3 can be preliminarily set as a table corresponding to the voltage and the gray scale of the video signal lines immediately before the black writing. The timing for the black writing and a function of instructing grayscales to the video signal line drive circuit DD are realized using the controller TCON, and, hence, it is possible to easily realize a change in the instruction data at the time of performing black writing to the video signal line drive circuit DD at the time of performing black writing by reference to the table.

FIG. 17 shows the concept of the present invention in which, in a display device which displays a black image by periodically inserting a black image, a voltage of video signal lines which correspond to a black image displayed by insertion is set to a value different from a voltage of the video signal lines at the time of performing a black image display as an image.

In FIG. 17, the above-mentioned different value is set lower than the voltage of the video signal lines at the time of displaying the black image which constitutes an image when the polarity of a video signal immediately before the black image displayed by insertion assumes a positive polarity. Since here a concept is assumed which obviates the fluctuation of the black voltage attributed to the voltage of preceding polarity, the above-mentioned different value is set higher than the voltage of the video signal at the time of displaying the black image which constitutes an image when the polarity of a video signal immediately before the black image displayed by insertion assumes a negative polarity.

Figure 18:
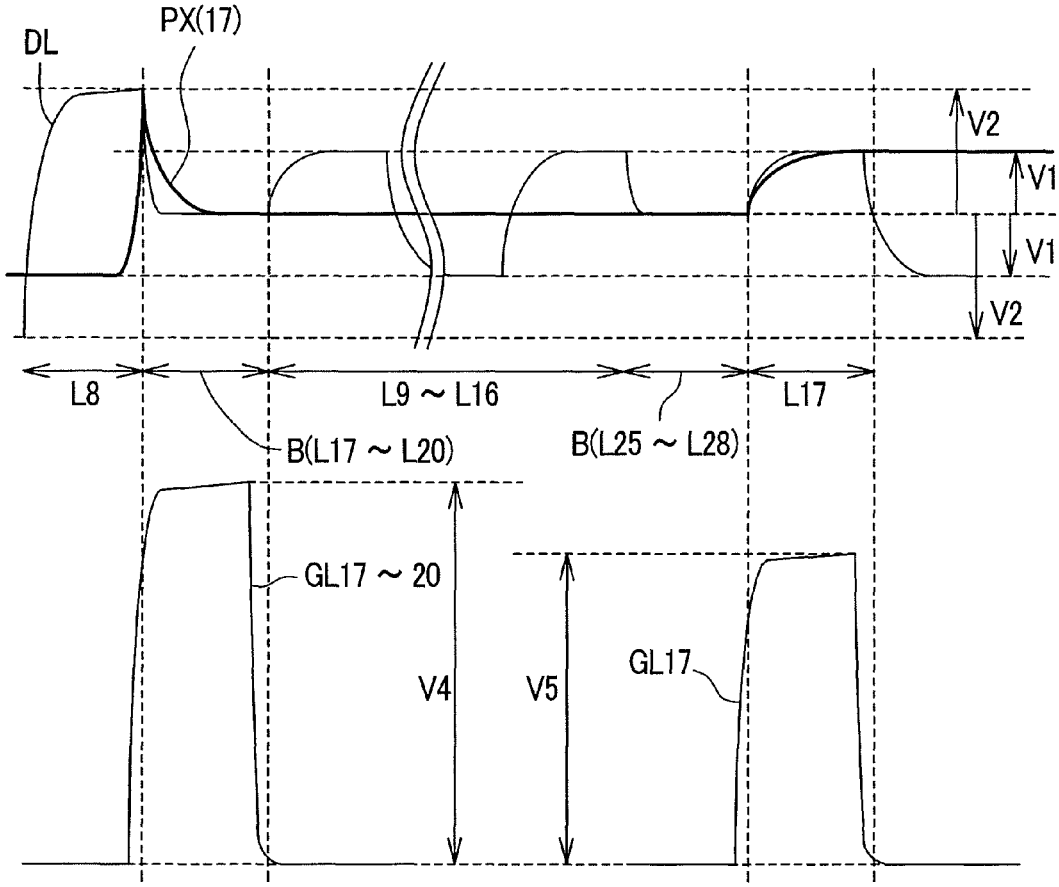
FIG. 18 is a diagram showing one example of driving according to the present invention.

FIG. 18 shows the third concept and corresponds to FIG. 16. This concept is characterized in the fact that it is assumed that for the gate ON voltage (GL17 to GL20), which corresponds to the black writing as V4 and the writing voltage (GL17) of the usual display image as V5, the relationship V4>V5 is established. Accordingly, during the period B (L17 to L20), which is the black writing timing, the writing of the black voltage of the video signal lines DL to the pixel electrodes is enhanced, and the black potential is written in the voltage PX(17) of the pixel electrodes. Here, although a writing ratio is enhanced also with respect to the usual image by increasing the ON voltage of all gate signal lines GL, the power consumption is increased in such a case. For example, when the voltage of the gate signal lines GL is also elevated in a white display, where the amplitude of the video signals becomes maximum, an electric energy which is used instantaneously as the display device is increased correspondingly, thus leading to an increase in the maximum power consumption. Since it is necessary to provide a power source circuit PS and various safety circuits to cope with the maximum power consumption, the increase of the maximum power consumption directly pushes up the cost. On the other hand, even when the ON voltage is elevated only when a black display is produced, the amplitude of the video signals is minimum in the black display, and, hence, with respect to the whole display device, the electric energy is still lower at the black display than at the time of usual image display. Accordingly, when only the gate ON voltage which corresponds to the black writing is elevated, it is possible to obviate an increase in the maximum power consumption.

FIG. 18 shows a concept of the present invention in which, in a display device which displays a black image by periodically inserting a black image, an ON voltage of the gates which correspond to the black image displayed by insertion is set higher than an ON voltage of the other gates.

Figure 19:
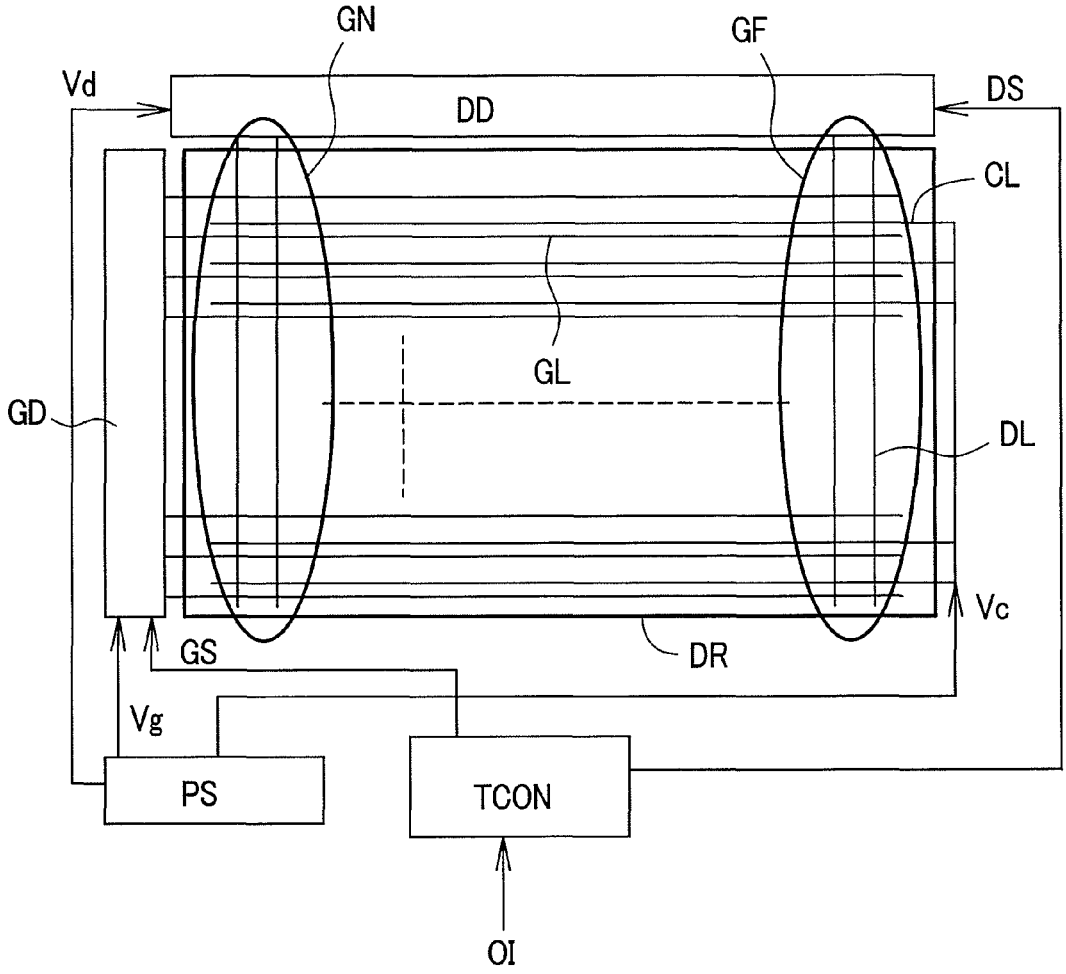
FIG. 19 is a diagram showing a side close to a gate signal line drive circuit and a side remote from the gate signal line drive circuit.

FIG. 19 is a view which corresponds to FIG. 1, wherein a side arranged close to the gate signal line drive circuit GD is set as GN and a side arranged remote from the gate signal line drive circuit GD is set as GF. The fact that ghost Y is liable to strongly appear on the gate signal line drive circuit GD side will be explained. The reason for this phenomenon is that the dullness of the waveform of the gate signal lines GL is small on the side close to the gate signal line drive circuit GD, and, hence, a steep rising and falling can be achieved whereby the display image of the preceding line is written with high efficiency at the time of producing a black display. Accordingly, as explained in conjunction with FIG. 16, by shifting the rising timing of the gate signal lines GL only at the time of black writing, it is possible to cope with this drawback. However, when a lateral difference exists with respect to the ghost, the lateral difference arises also with respect to the advantageous effect to shift the timing. Further, so long as black data is to be written, the shift amount is also limited.

Figure 20:
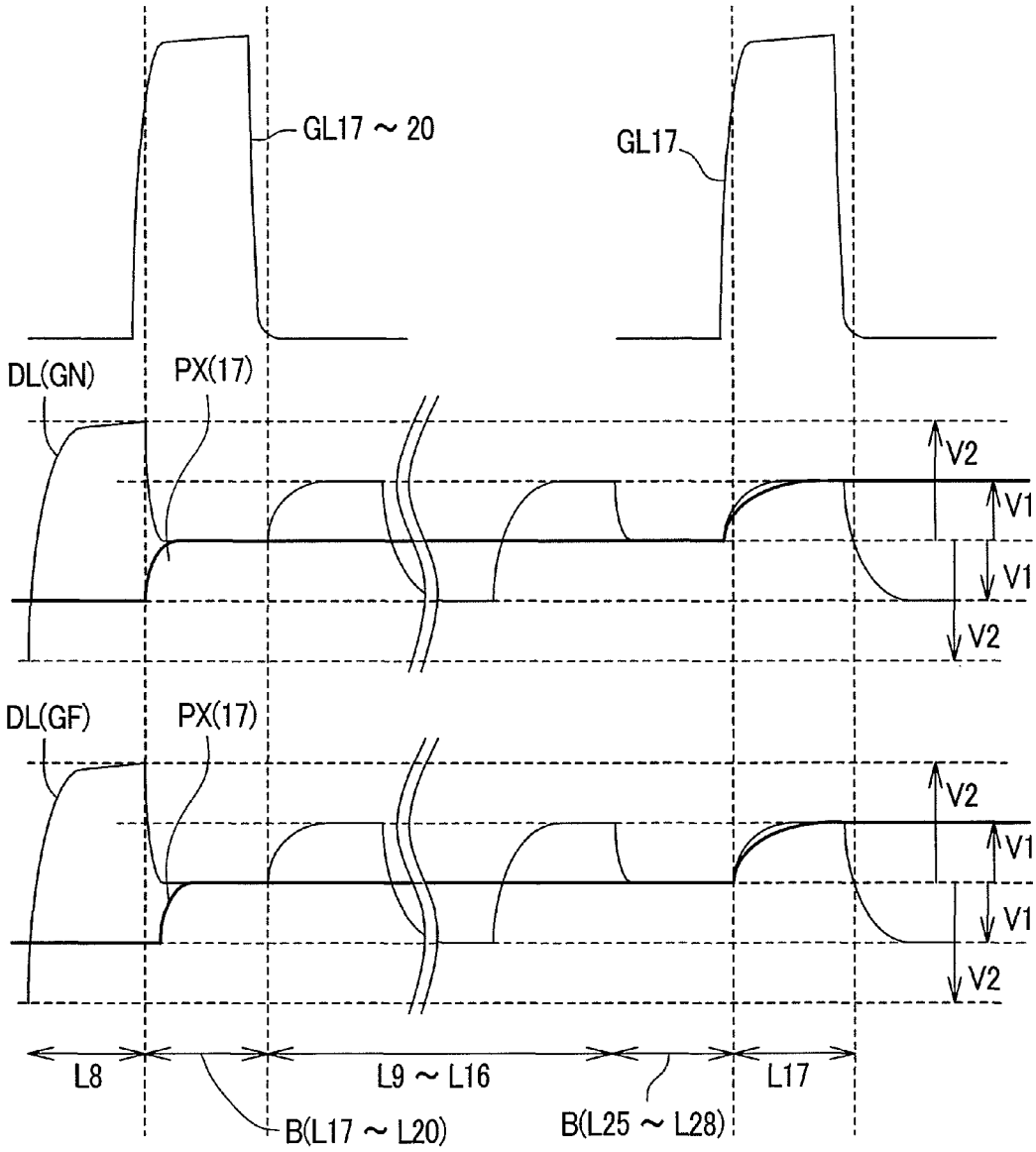
FIG. 20 is a diagram showing on example of driving according to the present invention.

Accordingly, FIG. 20 shows a driving method which more positively eliminates this lateral difference. In the drawing, the upper stage corresponds to the gate signal line GL and the intermediate stage corresponds to the upper stage shown in FIG. 16 on a side close to the gate signal line drive circuit GD, wherein the signal of the video signal lines becomes DL (GN). In the drawing, the lower stage corresponds to the upper stage in FIG. 16 on a side remote from the gate signal line drive circuit GD, and the signal of the video signal lines becomes DL (GF).

The gate signal lines GL17 to GL20, the line GL17, the line DL(GN) and the line DL(GF) will be compared. Broken lines extending in the vertical direction in the drawing are lines depicted to compare the timings of GL and DL. The line DL(GN) rises earlier than the line DL(GF) and falls earlier than the line DL(GF). That is, the synchronism of the video signal line DL and the gate signal line GL is shifted on the side close to the gate signal line drive circuit GD and on the side remote from the gate signal line drive circuit GD. Due to such a constitution, the video signal line DL(GN) on the side close to the gate signal line drive circuit GD, that is, on the side where the rising of the gate signal is steep, sets a time between the starting of the rising of the gate signal line GL and the starting of the rising of the video signal line DL, or a time between the starting of the falling of the gate signal line GL and the starting of the rising of the video signal line DL, shorter than a corresponding time of the video signal line DL(GL) on the side remote from the gate signal line drive circuit GD, that is, on the side where the rising of the gate signal is dull.

Accordingly, it is possible to prevent the writing of the display data of the preceding line in black on the side GN close to the gate signal line drive circuit, while it is possible to prevent the signal of the next line from being written before the switching element TFT is turned off on the side GF remote from the gate signal line drive circuit. Accordingly, it is possible to eliminate the lateral difference in ghost without giving the influence to the display image.

FIG. 20 shows a concept of the present invention in which, in a display device which displays a black image by periodically inserting a black image, the timing at which the video signal line rises with respect to the rising of the gate signal line GL is set earlier on a side close to the gate signal line drive circuit relative to a side remote from the a gate signal line drive circuit.

An example of a method which shifts the timing between DL(GN) and DL(GF) is explained next.

Figure 21:
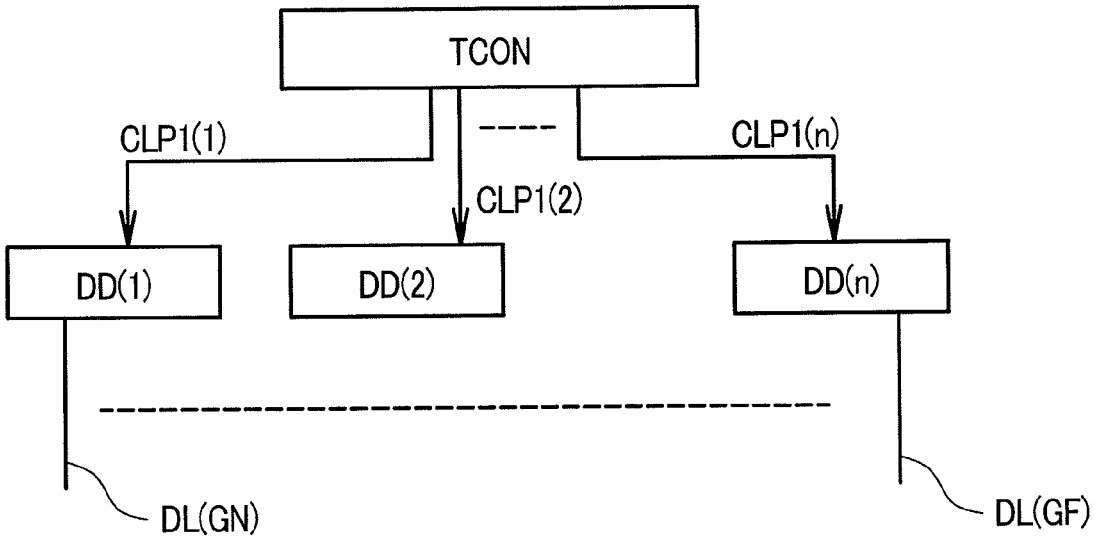
FIG. 21 is a block diagram showing one example of a system according to the present invention.
Figure 22:
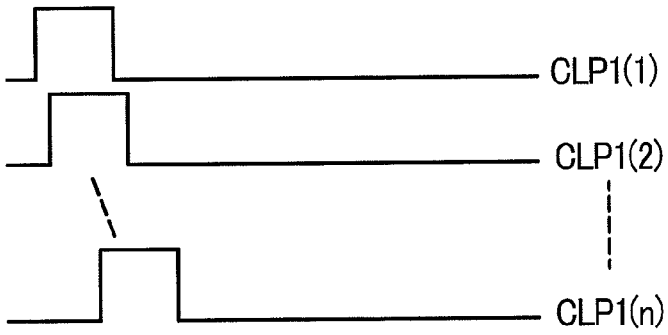
FIG. 22 is a timing diagram showing a shifted transmission of a clock pulse according to the present invention.

FIG. 21 shows an example in which the video signal line drive circuit DD is divided into a group consisting of a plurality of groups of drive circuits as in the case of DD(1), DD(2), . . . , DD(n), and control is performed for every group of drive circuits. The group of drive circuits may be determined per a TCP unit, a COG-type semiconductor chip unit or the like. To each group of drive circuits, a clock pulse CLP1 is supplied, which instructs the timing for outputting a signal to the video signal lines DL from the controller TCON. Each group of drive circuits output a video signal based on the clock pulse signal CLP1 to the video signal line DL. Conventionally, the clock pulse signal CLP1 is commonly used by all groups of drive circuits, and, hence, all groups of drive circuits output the video signal DL simultaneously. However, in the constitution shown in FIG. 21, the clock pulse signal CLP1 is made independent for respective groups of drive circuits and is supplied at timings which conform to the respective groups of drive circuits, as in the case of CLP1(1), CLP1(2), . . . , CLP1(*n*), so as to realize the correspondence shown in FIG. 20. As an example of the timings, for example, as shown in FIG. 22, it is possible to achieve the timings by slightly shifting the clock pulse signals CLP1, CLP1(2), . . . , CLP1(*n*) from each other. Here, in FIG. 21, since it is assumed that the outputting is performed when the pulses rise or fall, there is no problem even when the pulses have an overlapped period. The concept of shifting the output timings of the video signal lines DL constitutes an aspect of the present invention which can not only cope with the ghost problem, but also is generally broadly applicable as a countermeasure to cope with the various display drawbacks attributed to the fact that the waveform dullness of the signal supplied to the gate signal lines GL differ laterally on the screen.

Figure 23:
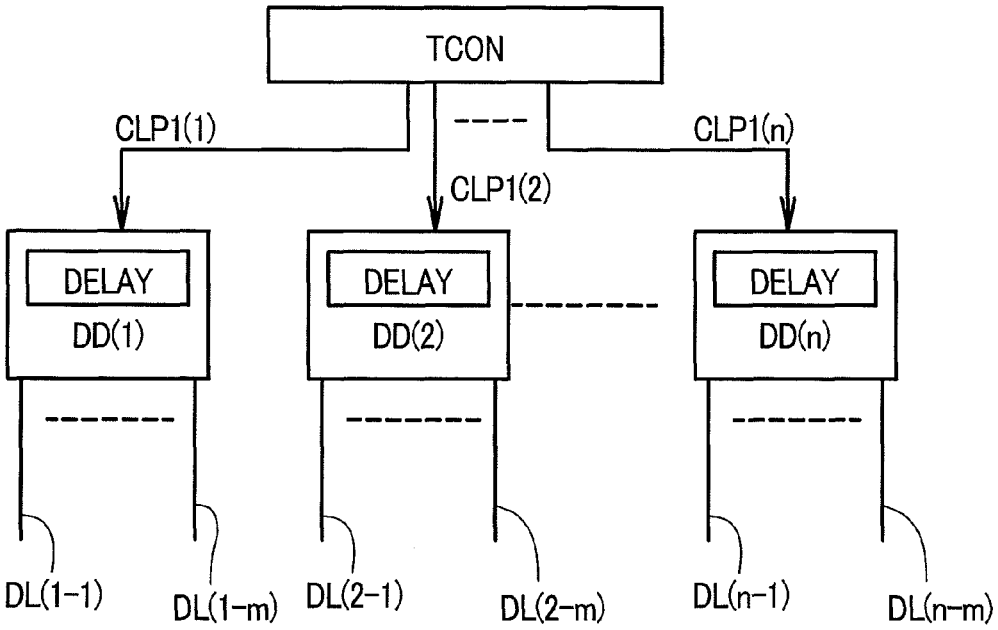
FIG. 23 is a block diagram showing one example of a system according to the present invention.

FIG. 23 shows a modification of the constitution shown in FIG. 21. The example shown in FIG. 21 is directed to the control of the groups of drive circuits, that is, for every TCP or for every COG chip, thus providing a constitution in which the timing is sharply shifted between the groups of drive circuits. FIG. 23 shows an example of a constitution which can eliminate the sharp shifting of the timing among the groups of drive circuits. The point which makes the constitution shown in FIG. 23 different from the constitution shown in FIG. 21 lies in that a delay circuit DELAY is provided in the inside of the group of drive circuits and the timing is shifted also in the group of drive circuits. The clock pulse which is supplied to the groups of drive circuits as CLP1(1), CLP1(2), . . . , CLP1(*n*) is regenerated by the delay circuit DELAY in the groups of drive circuits.

Figure 24:
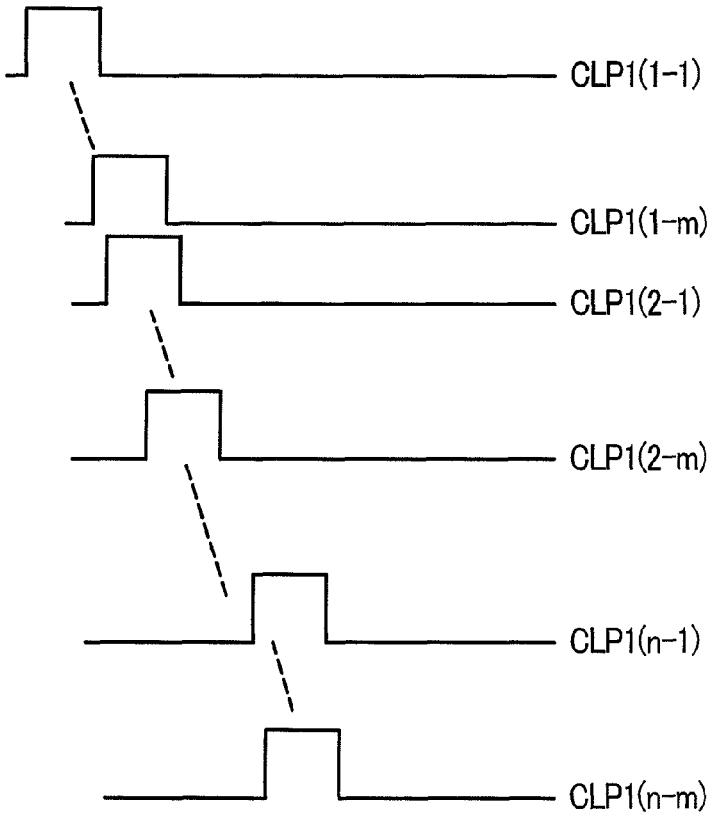
FIG. 24 is a timing diagram showing a shifted transmission of a clock pulse according to the present invention.

FIG. 24 shows the clock pulses after being regenerated by the delay circuit. CLP1(1-1) to CLP1(1-*m*) are regenerated with respect to CLP1(1), CLP1(2-1) to CLP1(2-*m*) are regenerated with respect to CLP1(2), and CLP1(*n*−1) to CLP1(*n*-*m*) are regenerated with respect to CLP1(*n*). The regenerated clock pulses are generated at the timings which are shifted for every one line or every plural lines in the inside of the groups of the drive circuits, and the clock pulses are outputted to the corresponding video signal lines DL(1-1) to DL(1-*m*), DL(2-1) to DL(2-*m*), and DL(n−1) to DL(n-m) from the respective groups of drive circuits in response to the timings.

Figure 25:
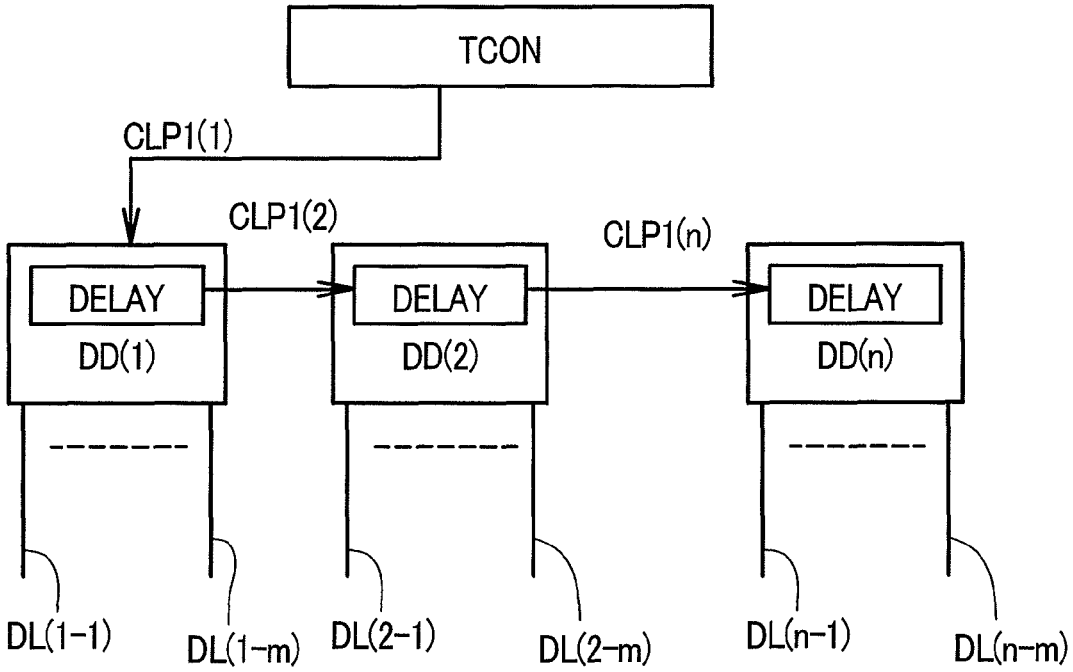
FIG. 25 is a block diagram showing an example of a dummy pattern.

FIG. 25 shows an example of an improvement with respect to the constitution shown in FIG. 23. Although independent clock pulses CLP1 are supplied to the respective groups of drive circuits in FIG. 23, in the example shown in FIG. 25, CLP1(1) is supplied to the first group of drive circuits and, thereafter, using the delay circuit DELAY incorporated in the group of drive circuits, CLP1 is sequentially supplied such that CLP1(2) is supplied to the next group of drive circuits at a timing which is delayed from CLP1(1), and CLP1(3) is supplied to still the next group of drive circuits at the timing which is further delayed from CLP1(1). Due to such a constitution, the number of wirings of CLP1 from the controller TCON to the groups of drive circuits can be decreased and hence, it is possible to obtain an advantage in that it is possible to reduce the EMI attributed to electromagnetic waves irradiated from the wirings, as well as to attain a reduction of cost attributed to the reduction of number of the terminals of the controller TCON.

Figure 26:
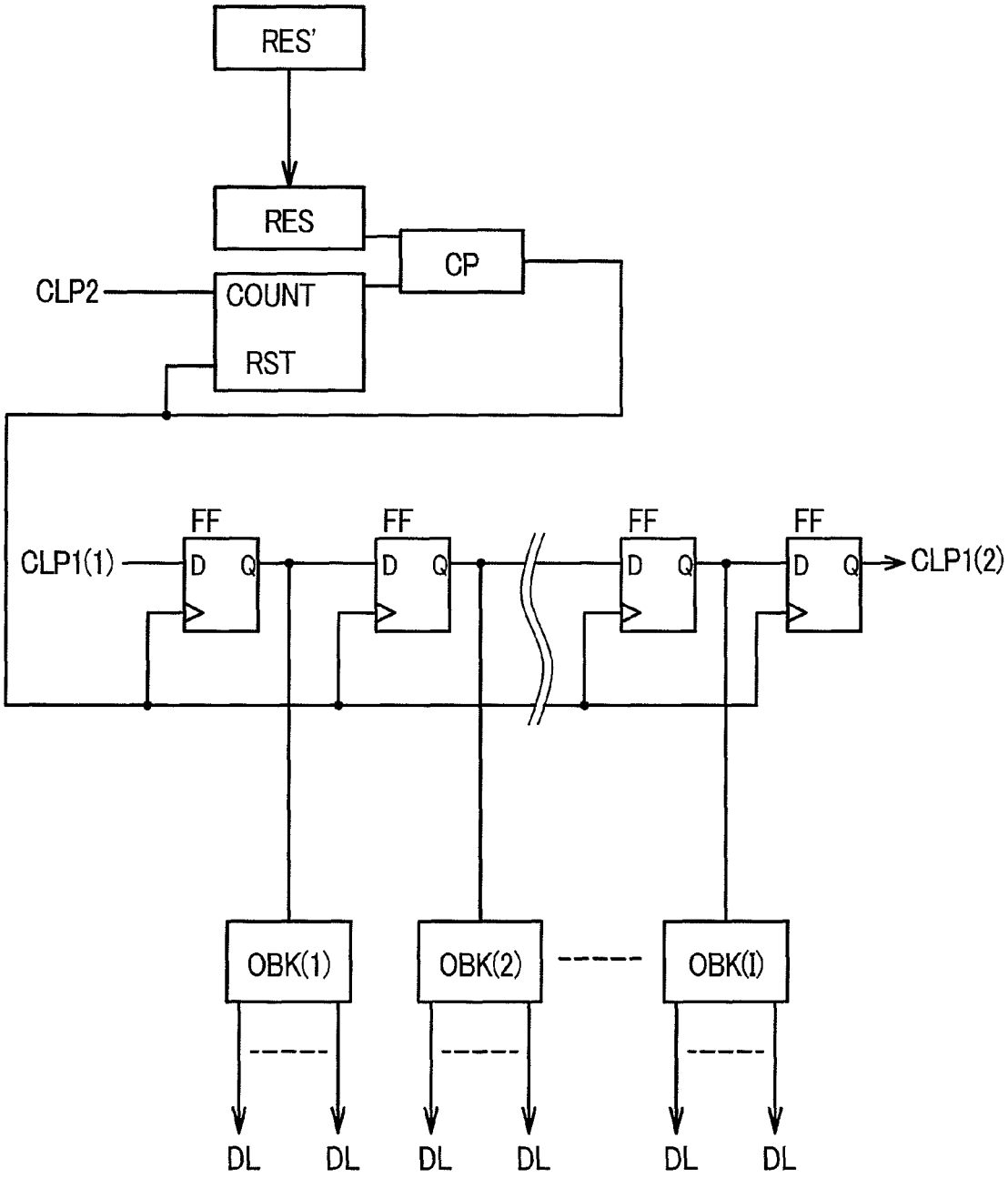
FIG. 26 is a block diagram showing one example of a system according to the present invention.

FIG. 26 shows one example of the delay circuit DELAY in the driver. A data receiving circuit RES' receives data which determines a delay amount from the controller TCON and inputs the data into a register RES. Here, when the delay amount is fixed, it is possible to omit the data receiving circuit RES' by allowing the register RES to store a fixed value. However, by allowing dynamic delay control based on an instruction received from the controller TCON using the data receiving circuit RES', it is possible to set the delay amount to an optimum value with respect to the process fluctuation of the switching element TFT, and it is also possible to set the delay amount to an optimum value in response to the images. The number of inputs of data latch clocks CLP2 is counted using a counter COUNT, and the counter value and the register value are compared with each other using a comparator CP. When the counter value reaches the register value, the output of the comparator CP is turned on. When the comparator CP is turned on, the output of the comparator CP enters a reset input RST so as to initialize the value of the counter. Accordingly, assuming that the predetermined value to the register is z, a pulse is generated at a cycle of every z clocks. The pulse generated for every z clock from the comparator CP and the clock pulse CLP1(1) are inputted to a flip-flop circuit FF. The flip-flop circuit FF generates an output when the pulse is inputted for every z clock. The output becomes an input corresponding to CLP1(1) of the next flip-flop circuit FF. Further, the pulse for every z clock is inputted to this next flip-flop circuit FF and an output thereof is turned on at a point of time at which the pulse for the first every z clock is inputted after the input from the first flip-flop circuit is turned on. By repeating the above constitution, the DELAY circuit is constituted. The output from the first flip-flop circuit FF is simultaneously connected to an output terminal block OBK(1). The output terminal block OBK(1), upon receiving an ON signal from the flip-flop circuit FF, outputs a given image signal to the video signal lines DL. Thereafter, ON signals from the flip-flop circuits FF, which are connected with the output terminal blocks OBK(2), OBK(3), . . . OBK(l), are sequentially inputted with time lags, and, hence, given image signals are sequentially outputted to the video signal lines DL for every block. Then, all flip-flop circuits FF inside of the group of drive circuits are turned on, and the delayed CLP1 is outputted to the next group of drive circuits as CLP1(2).

The flip-flop circuits FF may be constituted to correspond to the respective video signal lines DL. However, from a viewpoint that such a constitution increases the circuit scale, it is desirable that approximately several to several tens of flip-flop circuits FF are formed in one group of drive circuits. For example, when the wiring delay of the gate signal of the gate signal line GL, which is generated on the side remote from the gate signal line drive circuit GD with respect to the side close to the gate signal line drive circuit GD, is 5 μs and the total number of groups of drive circuits which constitute the video signal line drive circuit DD is ten, the delay of 0.5 μs may be imparted for every one group of drive circuits in one technique. Here, when ten output terminal blocks OBK are provided inside each group of drive circuits, the delay amount between respective blocks becomes 0.05 μs. Accordingly, the difference in the delay amount between the blocks is trivial and the difference hardly can be viewed with naked eye. Accordingly, it is not always necessary to provide the flip-flop circuits individually with respect to all video signal lines DL; and, even when the flip-flop circuit is provided to the output terminal block unit which is formed of a unit consisting of several to several tens of video signal lines, it is possible to suppress an increase of the circuit scale while achieving the desired advantages.

The concepts of the present invention as described in detail heretofore can achieve, particularly in a display device which periodically displays a black image, the remarkable advantages of improving the display image which is generated by the peculiar operations of the display device. Further, these concepts become more crucial along with a large-sizing of the display device to not less than 17 inches. Further, these concepts become more crucial when the operational frequency is enhanced (for example, not less than 80 Hz) to further improve the response speed as viewed with naked eye by increasing the interval e at which the black appears. Still further, these concepts become more crucial and effective when the method for periodically displaying black is applied to a display device having a large pixel capacitance, for example, in connection with a display device in which both of the pixel electrodes and the common electrode are formed on the same substrate. Still further, these concepts become more crucial and effective in a display device in which either one of the pixel electrodes and the common electrode has a planar shape, which is formed on a major portion of one pixel, and another has a plurality of linear portions or slit portions.

Further, by using the various concepts disclosed in the present application to cope with the drawbacks of the related art in combination, it is possible to enhance the advantages of the present invention. Even when all examples of various combinations are not individually described, those who are skilled in the art can sufficiently understand the manner of exercising these combinations.

What is claimed is:

1. A display device which displays a black image by periodically inserting the black image, wherein an ON voltage of gate signal lines which is turned on firstly after displaying the black image is set to a value different from an ON voltage of the gate signal lines which are turned on subsequently.

2. A display device according to claim 1, wherein the ON voltage of gate signal lines which is turned on firstly after displaying the black image is driven in a state that a first video signal after displaying the black image and a succeeding video signal differ in polarity and is set lower than an ON voltage of the gate signal lines which is turned on secondly after displaying the black image.

3. A display device according to claim 1, wherein the ON voltage of gate signal lines which is turned on firstly after displaying the black image is driven in a state that a first video signal after displaying the black image and a succeeding video signal are equal in polarity and is set higher than an ON voltage of the gate signal lines which is turned on secondly after displaying the black image.

4. A display device which displays a black image by periodically inserting the black image, wherein when a signal which allows the display device to display a display image having uniform luminance is inputted from the outside, a voltage of a first video signal and a voltage of a third video signal after displaying the black image take values different from each other.

5. A display device according to claim 4, wherein in driving the display device in a state that the first video signal and the second video signal after displaying the black image are different from each other in polarity, the voltage of the first video signal is lower than the voltage of the third video signal.

6. A display device according to claim 4, wherein in driving the display device in a state that the first video signal and the second video signal after displaying the black image are equal in polarity, the voltage of the first video signal is higher than the voltage of the second video signal.

* * * * *